US011099517B2

(12) United States Patent
Nakamura et al.

(10) Patent No.: US 11,099,517 B2
(45) Date of Patent: Aug. 24, 2021

(54) METAL FRAME OF IMAGE FORMING APPARATUS AND IMAGE FORMING APPARATUS

(71) Applicant: CANON KABUSHIKI KAISHA, Tokyo (JP)

(72) Inventors: Michinori Nakamura, Kashiwa (JP); Takahiro Kobayashi, Nagareyama (JP); Ken Swysen, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/004,488

(22) Filed: Aug. 27, 2020

(65) Prior Publication Data

US 2021/0063944 A1 Mar. 4, 2021

(30) Foreign Application Priority Data

Aug. 30, 2019 (JP) ..... JP2019-158412
Aug. 30, 2019 (JP) ..... JP2019-158418

(51) Int. Cl.
*G03G 15/00* (2006.01)
*G03G 21/16* (2006.01)

(52) U.S. Cl.
CPC ..... *G03G 21/1619* (2013.01); *G03G 21/1633* (2013.01)

(58) Field of Classification Search
CPC ..... G03G 21/1619; G03G 21/1633; G03G 21/1647
See application file for complete search history.

(56) References Cited

U.S. PATENT DOCUMENTS 8,611,790 B2 * 12/2013 Souda ..... G03G 21/1619 399/121
9,188,935 B2 * 11/2015 Nishimura ..... G03G 21/1652
9,442,458 B2 9/2016 Kobayashi et al.
10,775,733 B2 9/2020 Kobayashi et al.
(Continued)

FOREIGN PATENT DOCUMENTS

JP 2008-116619 A 5/2008

OTHER PUBLICATIONS

U.S. Appl. No. 17/004,464, filed Aug. 27, 2020.
U.S. Appl. No. 17/004,529, filed Aug. 27, 2020.
U.S. Appl. No. 17/004,564, filed Aug. 27, 2020.

*Primary Examiner* — Hoang X Ngo
(74) *Attorney, Agent, or Firm* — Venable LLP

(57) ABSTRACT

A metal frame of an image forming apparatus includes first and second spaced-apart supports which together support an image forming unit of the image forming apparatus. The second support includes first and second metal sheets wherein the first sheet metal includes a first flat surface portion in which a through-hole is formed and a bent and raised portion which is bent and raised from the first flat surface portion at a position adjacent to the through-hole, and wherein the second sheet metal is supported to the first sheet metal and includes a second flat surface portion which is sandwiched between the first flat surface portion and the bent and raised portion, and a protruded portion which protrudes from the second flat surface portion in a plate thickness direction of the second flat surface portion at a position overlapping with the through-hole in a vertical direction.

28 Claims, 32 Drawing Sheets

(56) References Cited

U.S. PATENT DOCUMENTS

| | | | | |
|---|---|---|---|---|
| 2012/0219316 | A1* | 8/2012 | Souda | G03G 21/1619 399/107 |
| 2015/0177680 | A1* | 6/2015 | Souda | G03G 21/1619 399/107 |
| 2020/0094302 | A1 | 3/2020 | Yahagi et al. | |

* cited by examiner

METAL FRAME OF IMAGE FORMING APPARATUS AND IMAGE FORMING APPARATUS

BACKGROUND OF THE INVENTION

Field of the Invention

The present invention relates to a metal frame of an image forming apparatus such as an electrophotographic copying machine and an electrophotographic printer (for example, a laser beam printer or a light emitting diode (LED) printer), and an image forming apparatus.

Description of the Related Art

A frame of an image forming apparatus is generally formed by joining a plurality of sheet metals such as a front side plate, a rear side plate, and a stay connecting between the front side plate and the rear side plate to each other by welding or the like. By joining such sheet metals to each other in a state where they are assembled to each other with high position accuracy, position accuracy between respective members supported by the frame is maintained, such that it becomes possible to form a high-quality image.

Meanwhile, Japanese Patent Application Laid-Open No. 2008-116619 describes a configuration for assembling a first sheet metal and a second sheet metal, which are sheet metals constituting a frame of an image forming apparatus, to each other with high position accuracy. The configuration described in Japanese Patent Application Laid-Open No. 2008-116619 is a configuration in which a protrusion portion formed on the first sheet metal is inserted into an opening portion formed in the second sheet metal to assemble the first sheet metal and the second sheet metal to each other. A first bulging portion that abuts on one surface of the protrusion portion of the first sheet metal in a plate thickness direction and a second bulging portion that abuts on the other surface of the first sheet metal in the plate thickness direction are formed inside the opening portion of the second sheet metal. By nipping the protrusion portion from the plate thickness direction by the first bulging portion and the second bulging portion, a position of the first sheet metal with respect to the second sheet metal in the plate thickness direction is determined. In addition, in a direction orthogonal to an insertion direction of the first sheet metal into the second sheet metal and the plate thickness direction of the first sheet metal, by making a width of the opening portion and a width of the protrusion portion substantially the same as each other, a position of the first sheet metal with respect to the second sheet metal in the orthogonal direction is determined.

However, in the configuration described in Japanese Patent Application Laid-Open No. 2008-116619, a portion that restricts movement of the first sheet metal with respect to the second sheet metal in a direction opposite to the insertion direction is not provided. Therefore, in a case where an unintended force is applied to the first sheet metal or the second sheet metal in a state where the first sheet metal is assembled to the second sheet metal, there is a possibility that the first sheet metal will move with respect to the second sheet metal in the direction opposite to the insertion direction, such that the first sheet metal and the second sheet metal are separated from each other, resulting in deterioration of position accuracy.

SUMMARY OF THE INVENTION

It is desirable to provide a metal frame of an image forming apparatus capable of preventing sheet metals constituting a frame from being separated from each other to deteriorate position accuracy.

According to an aspect of the present invention, a metal frame of an image forming apparatus including an image forming unit which forms an image on a sheet includes:

a first support which supports the image forming unit; and a second support which is arranged with an interval from the first support and supports the image forming unit together with the first support;

wherein the second support includes:

a first sheet metal which includes a first flat surface portion in which a through-hole is formed and a bent and raised portion which is bent and raised from the first flat surface portion at a position adjacent to the through-hole, and a second sheet metal which is supported to the first sheet metal on the first sheet metal and includes a second flat surface portion which is sandwiched between the first flat surface portion and the bent and raised portion and a protruded portion which protrudes from the second flat surface portion in a plate thickness direction of the second flat surface portion at a position overlapping with the through-hole in a vertical direction.

Further features of the present invention will become apparent from the following description of exemplary embodiments with reference to the attached drawings.

DESCRIPTION OF THE EMBODIMENTS

First Embodiment

<Image Forming Apparatus>

Hereinafter, first, an overall configuration of an image forming apparatus according to a first embodiment of the present invention will be described with reference to the drawings, together with an operation at the time of image formation. Note that dimensions, materials, shapes, relative arrangements, and the like of components described below are not intended to limit the scope of the present invention unless specifically stated otherwise.

An image forming apparatus A according to the present embodiment is an intermediate tandem type electrophotographic image forming apparatus that transfers toners of four colors of yellow Y, magenta M, cyan C, and black K to an intermediate transfer belt, and then transfers an image to a sheet to form the image. Note in the following description, Y, M, C, and K are added as subscripts to members using the toners of the respective colors, but since configurations or operations of the respective members are substantially the same as each other except that colors of the toners used in the respective members are different from each other, the subscripts are appropriately omitted unless it is necessary to distinguish the configurations or the operations of the respective members from each other.

Figure 1:
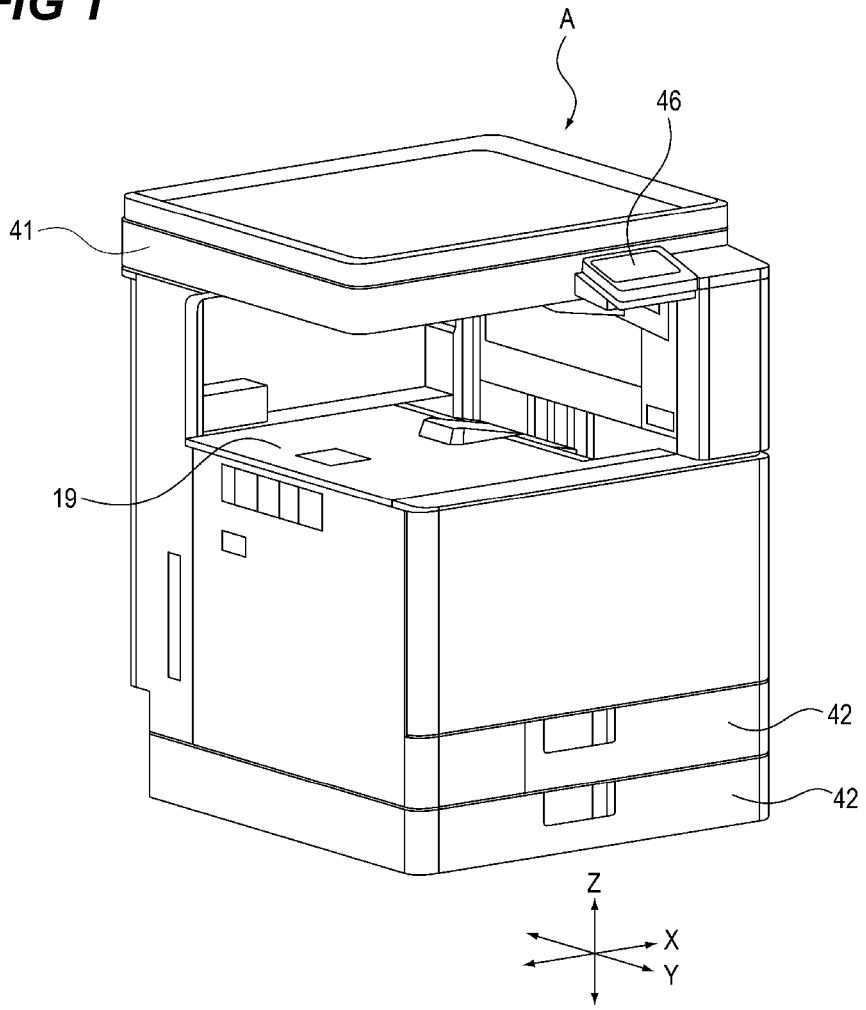
FIG. 1 is a schematic perspective view of an image forming apparatus.
Figure 2:
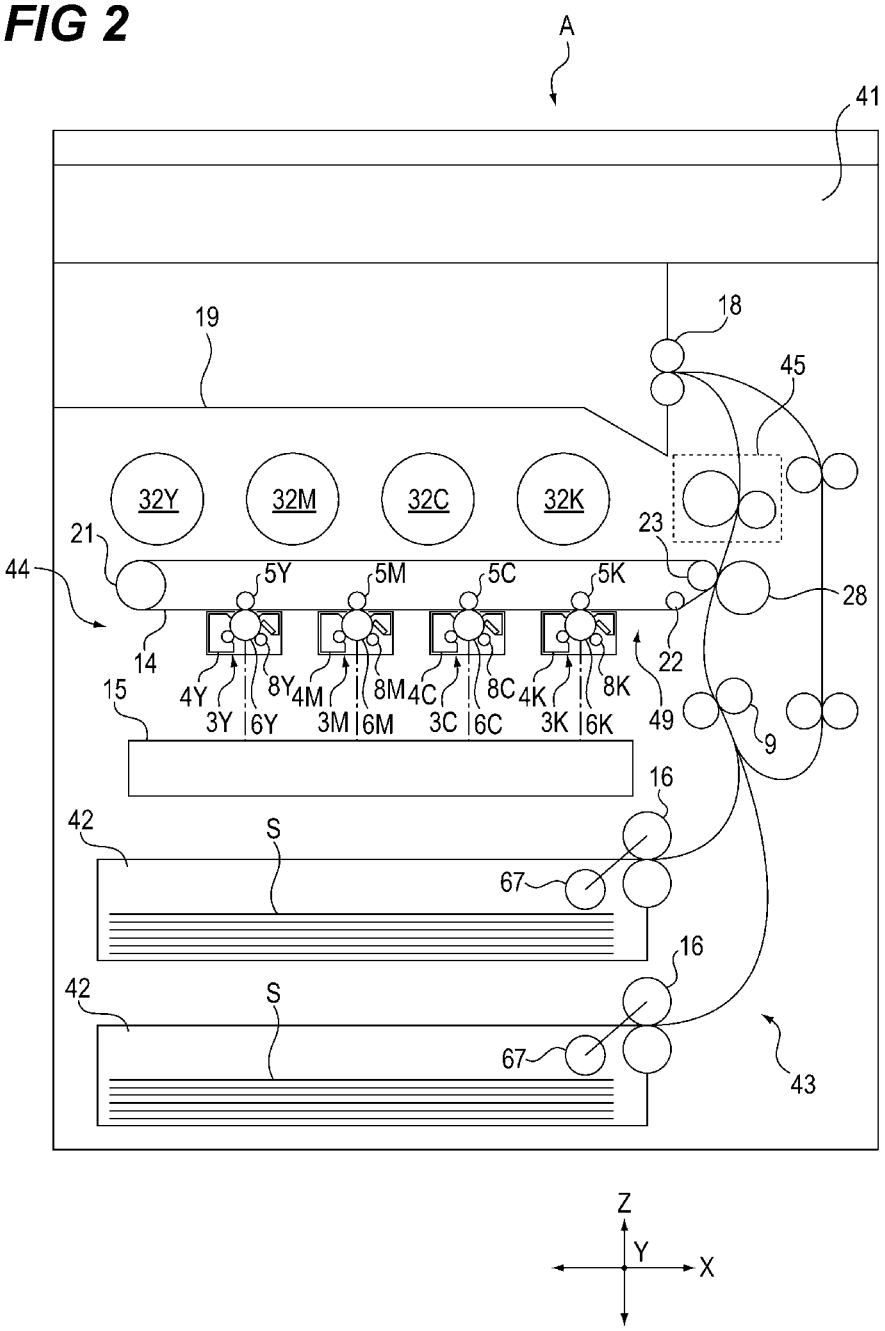
FIG. 2 is a schematic cross-sectional view of the image forming apparatus.

FIG. 1 is a schematic perspective view of an image forming apparatus A. FIG. 2 is a schematic cross-sectional view of the image forming apparatus A. As illustrated in FIGS. 1 and 2, the image forming apparatus A includes an image forming portion 44 that forms a toner image and transfers the toner image to a sheet, a sheet feeding portion 43 that feeds the sheet toward the image forming portion 44, and a fixing portion 45 that fixes the toner image to the sheet. In addition, an image reading portion 41 that reads an image of an original is provided at an upper portion of the image forming apparatus A.

The image forming portion 44 includes a process cartridge 3: 3Y, 3M, 3C, and 3K, a laser scanner unit 15, and an intermediate transfer unit 49. The process cartridge 3 is configured to be detachably attachable to the image forming apparatus A, and includes a photosensitive drum 6: 6Y, 6M, 6C, and 6K, a charging roller 8: 8Y, 8M, 8C, and 8K, a developing device 4: 4Y, 4M, 4C, and 4K.

The intermediate transfer unit 49 includes a primary transfer roller 5: 5Y, 5M, 5C, and 5K, an intermediate transfer belt 14, a secondary transfer roller 28, a secondary transfer counter roller 23, a driving roller 21, and a tension roller 22. The intermediate transfer belt 14 is stretched over the secondary transfer counter roller 23, the driving roller 21, and the tension roller 22, the driving roller 21 rotates by a driving force of a motor (not illustrated), and the intermediate transfer belt 14 circularly moves according to the rotation of the driving roller 21.

Next, an image forming operation by the image forming apparatus A will be described. First, when an image forming job signal is input to a controller (not illustrated), a sheet S stacked and stored in a sheet cassette 42 is sent out to a registration roller 9 by a feeding roller 16. Next, the sheet S is sent into a secondary transfer portion including the secondary transfer roller 28 and the secondary transfer counter roller 23 at a predetermined timing by the registration roller 9.

Meanwhile, in the image forming portion, first, a surface of the photosensitive drum 6Y is charged by the charging roller 8Y. Then, the laser scanner unit 15 irradiates the surface of the photosensitive drum 6Y with laser light according to an image signal transmitted from an external device (not illustrated) or the like to form an electrostatic latent image on the surface of the photosensitive drum 6Y.

Then, a yellow toner is attached to the electrostatic latent image formed on the surface of the photosensitive drum 6Y by the developing device 4Y to form a yellow toner image on the surface of the photosensitive drum 6Y The toner image formed on the surface of the photosensitive drum 6Y is primarily transferred to the intermediate transfer belt 14 by applying a bias to the primary transfer roller 5Y.

Magenta, cyan, and black toner images are also formed on the photosensitive drums 6M, 6C, and 6K by a similar process. These toner images are transferred in a superimposed manner onto the yellow toner image on the intermediate transfer belt 14 by applying a primary transfer bias to the primary transfer rollers 5M, 5C, and 5K. As a result, a full-color toner image is formed on a surface of the intermediate transfer belt 14.

Note that when the toner inside the developing device 4 is used by the developing process described above, such that an amount of toner inside the developing device 4 decreases, each developing device 4 is replenished with a toner of each color by a toner bottle 32: 32Y, 32M, 32C, and 32K. The toner bottle 32 is configured to be detachably attachable to the image forming apparatus A.

Then, the intermediate transfer belt 14 circularly moves, such that a full-color toner image is sent to the secondary transfer portion. The full-color toner image on the intermediate transfer belt 14 is transferred to the sheet S by applying a bias to the secondary transfer roller 28 in the secondary transfer portion.

Then, the sheet S to which the toner image is transferred is subjected to heating and pressuring processing in the fixing portion 45, such that the toner image on the sheet S is fixed to the sheet S. Then, the sheet S to which the toner image is fixed is discharged to a discharge portion 19 by a discharge roller 18.

<Frame of Image Forming Apparatus>

Next, a frame 31 of the image forming apparatus A will be described.

Figure 3:
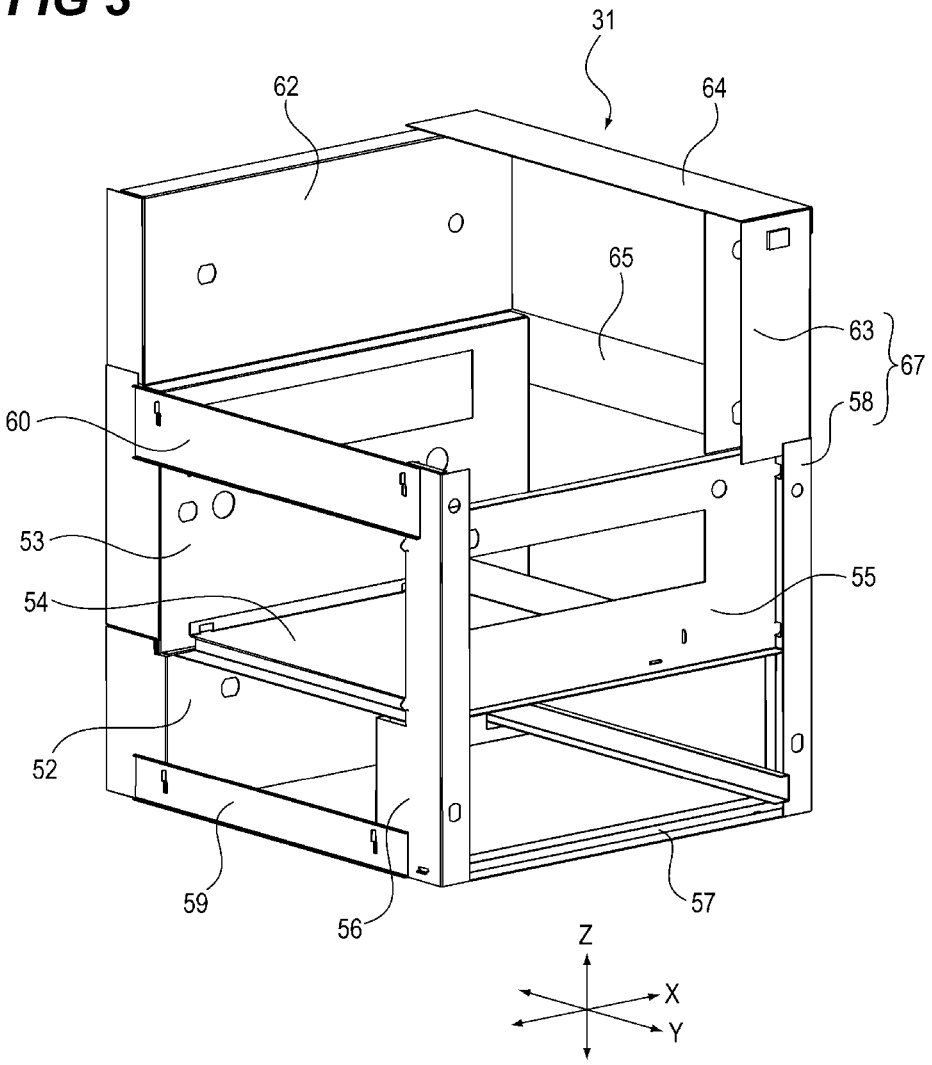
FIG. 3 is a perspective view of a frame of the image forming apparatus.
Figure 4:
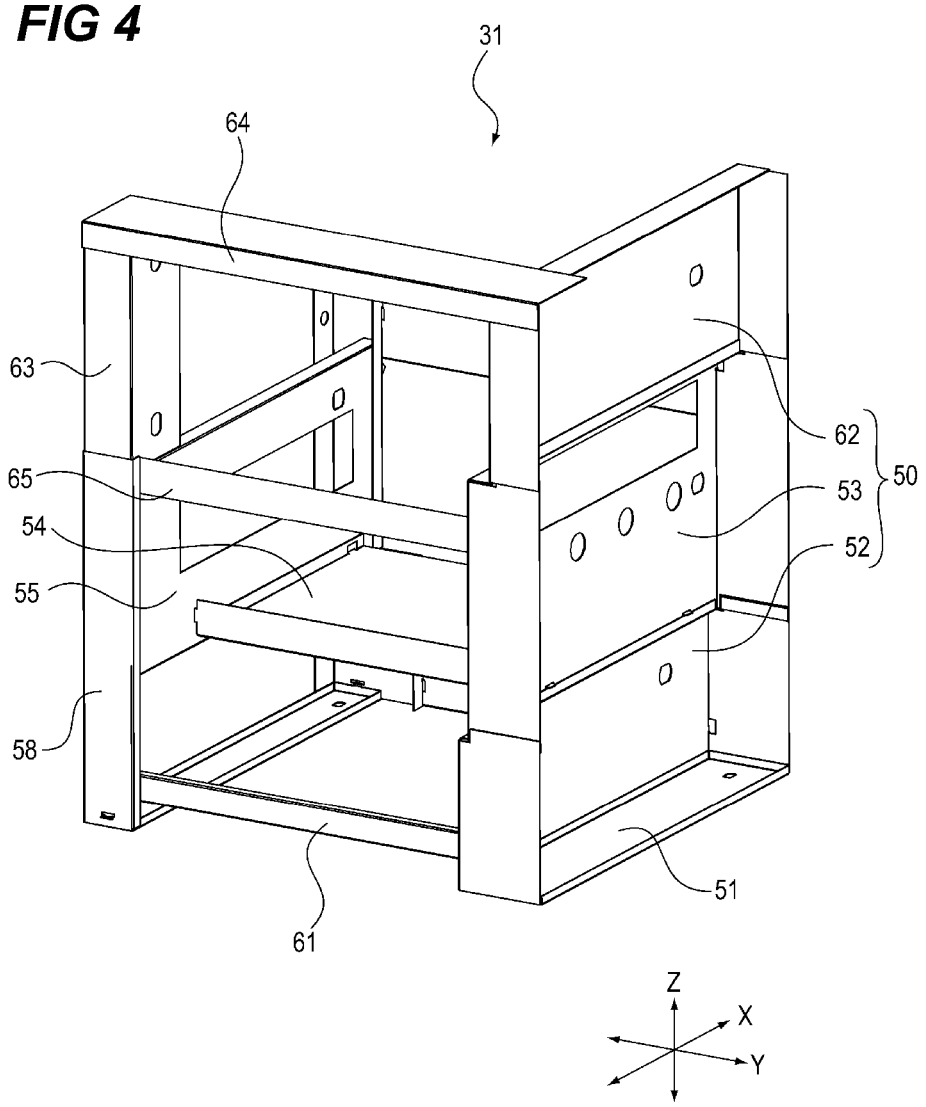
FIG. 4 is a perspective view of the frame of the image forming apparatus.

FIG. 3 is a perspective view of the frame 31 of the image forming apparatus A when viewed from a front surface side of the image forming apparatus A, and is a perspective view of a state where an internal unit such as an image forming unit or an exterior cover is removed. FIG. 4 is a perspective view of the frame 31 of the image forming apparatus A when viewed from a rear surface side of the image forming apparatus A. Note that an arrow X direction illustrated in the drawings is a horizontal direction and indicates a left and right direction of the image forming apparatus A. In addition, an arrow Y direction is a horizontal direction and indicates a front and rear direction of the image forming apparatus A. In addition, an arrow Z direction is a vertical direction and indicates an up and down direction of the image forming apparatus A. In addition, a front side of the image forming apparatus A is a side on which a user normally stands in order to operate an operation portion 46 for performing a setting regarding image formation, and a rear side of the image forming apparatus A is a side opposite to the front side across the frame 31. In addition, a left side of the image forming apparatus A is a left side when viewed from the front side, and a right side of the image forming apparatus A is a right side when viewed from the front side. In addition, the front side of the image forming apparatus A is a direction in which the sheet cassette 42 is pulled out from the image forming apparatus A when the sheet cassette 42 is replenished with sheets, and is a direction in which the toner bottle 32 is pulled out when the toner bottle 32 is replaced.

As illustrated in FIGS. 3 and 4, the image forming apparatus A includes a front side plate 55, a left support column 56, and a right support column 67 that are formed of a sheet metal, as the frame 31 on a front surface side thereof. The left support column 56 is connected to an end portion of one side of the front side plate 55 in the arrow X direction. The right support column 67 is connected to an end portion of the other side of the front side plate 55 in the arrow X direction. In addition, the right support column 67 includes a right support column 58 and a right support column 63 connected to an upper side of the right support column 58 in the vertical direction. The front side plate 55, the left support column 56, the right support column 67, and the front lower stay 57 are an example of a second support member.

In addition, the image forming apparatus A includes a rear side plate 50 formed of a sheet metal, as the frame 31 on a rear surface side thereof. The rear side plate 50 is arranged to face the front side plate 55, and supports the process cartridge 3 together with the front side plate 55. The rear side plate 50 supports a control board, a drive portion, or the like for controlling an operation of the image forming apparatus A on a surface opposite to a surface facing the front side plate 55. The rear side plate 50 is trisected into rear side plates 52, 53, and 62 in the vertical direction, the rear side plate (middle rear side plate) 53 is connected to an upper portion of the rear side plate (lower rear side plate) 52 in the vertical direction, and the rear side plate (upper rear side plate) 62 is connected to an upper portion of the rear side plate 53 in the vertical direction. Here, the rear side plate 53 supports an image forming unit such as the process cartridge 3 together with the front side plate 55. In addition, a plate thickness of a sheet metal of each of the rear side plates 52, 53, and 62 is about 0.6 mm to 2 mm. In addition, a rear bottom plate 51 is provided below the rear side plate 52.

In addition, the image forming apparatus A includes a left lower stay 59, a left upper stay 60, a right lower stay 61, a right middle stay 65, a right upper stay 64, and a middle stay 54, as the frame 31 connecting the frame 31 on the front surface side and the frame 31 on the rear surface side to each other. Here, the left lower stay 59, the left upper stay 60, the right lower stay 61, the right middle stay 65, the right upper stay 64, and the middle stay 54 are an example of a third support member for connecting the rear side plate 50, which is the frame 31 on the rear surface side, and the front side plate 55, the left support column 56, and the right support column 67, which are the frame 31 on the front surface side, to each other. The left lower stay 59 connects the left support column 56 and the rear side plate 52 to each other. The left upper stay 60 connects the left support column 56 and the rear side plate 53 to each other. The right lower stay 61 connects the right support column 58 and the rear side plate 52 to each other. The right middle stay 65 connects the rear side plate 53 and the right support column 58 to each other. The right upper stay 64 connects the right support column 63 and the rear side plate 62 to each other. The middle stay 54 connects the front side plate 55 and the rear side plate 53 to each other.

Note that each of the members constituting the frame 31 described above is formed of one sheet metal. These sheet metals are processed in a predetermined shape by drawing or the like, and then become the frame 31 through an assembling process and a joining process to be described later.

<Frame Assembling Process>

Next, a process of assembling a plurality of sheet metals constituting the frame 31 will be described. FIGS. 5 to 29B are views illustrating aspects where the sheet metals constituting the frame 31 are assembled.

Figure 5:
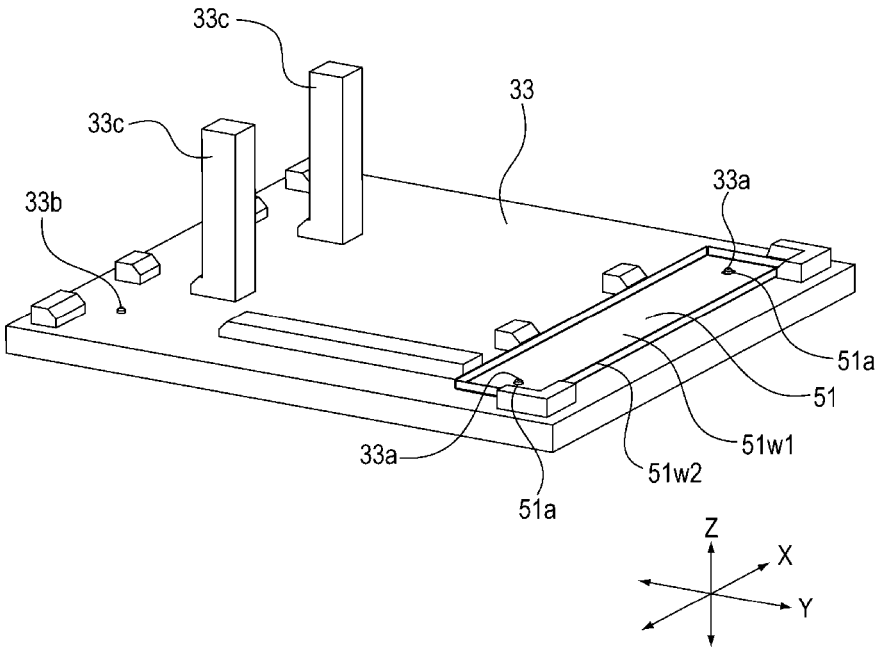
FIG. 5 is a perspective view when a rear bottom plate is assembled.

As illustrated in FIG. 5, a stand 33 is used when the sheet metals constituting the frame 31 are assembled. The stand 33 is provided with positioning pins 33*a* and 33*b* and support columns 33*c*. First, the rear bottom plate 51 is placed on the stand 33. The rear bottom plate 51 includes a flat surface portion 51*w*1 facing the stand 33, and a bent and raised portion 51*w*2 bent and raised from the flat surface portion 51*w*1. The bent and raised portion 51*w*2 is formed at least on a side engaging with the rear side plate 52. When the rear bottom plate 51 is placed on the stand 33, a position of the rear bottom plate 51 with respect to the stand 33 is determined by inserting the positioning pins 33*a* of the stand 33 into positioning holes 51*a* formed in the flat surface portion 51*w*1 of the rear bottom plate 51.

Figure 6A:
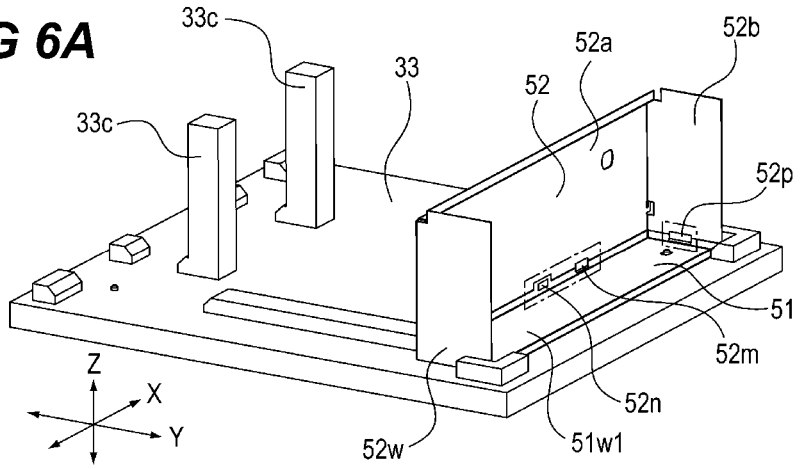
FIGS. 6A to 6C are perspective views when a rear side plate is assembled.
Figure 6B:
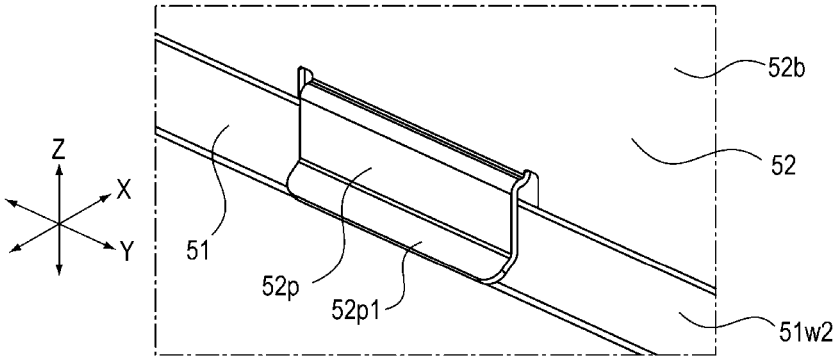
Figure 6C:
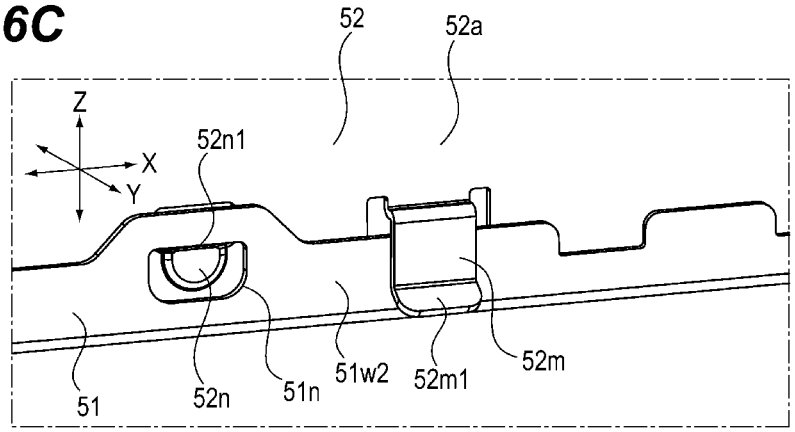

Next, as illustrated in FIGS. 6A to 6C, the rear side plate 52 is assembled. The rear side plate 52 is subjected to bending so as to have a U-shape having three flat surfaces. The rear side plate 52 includes a flat surface portion 52*a* located on a rear surface of the image forming apparatus A, and a bent portion 52*b* bent with respect to the flat surface portion 52*a* and extending rearward of the image forming apparatus A, and a bent portion 52*w* bent with respect to the flat surface portion 52*a* so as to face the bent portion 52*b*. The rear side plate 52 is inserted and assembled into the rear bottom plate 51. A projection portion 52*n* formed so as to protrude by drawing in a plate thickness direction of the flat surface portion 52*a* and a step-bent portion 52*m* are provided at a lower portion of the flat surface portion 52*a* of the rear side plate 52. A step-bent portion 52*p* is provided at a lower portion of the bent portion 52*b* of the rear side plate 52. The step-bent portion 52*m* has a portion bent in the plate thickness direction (arrow Y direction) of the flat surface portion 52*a* and a portion bent and extended from that portion in an insertion direction (arrow Z direction) of the rear side plate 52 into the rear bottom plate 51. The step-bent portion 52*p* has a portion bent in a plate thickness direction (arrow X direction) of the bent portion 52*b* and a portion bent and extended from that portion in the insertion direction of the rear side plate 52 into the rear bottom plate 51. In addition, a tip portion of the step-bent portion 52*m* is an inclined portion 52*m*1 inclined in a direction away from the flat surface portion 52*a* of the rear side plate 52 with respect to the insertion direction of the rear side plate 52 into the rear bottom plate 51. A tip portion of the step-bent portion 52*p* is an inclined portion 52*p*1 inclined in a direction away from the bent portion 52*b* of the rear side plate 52 with respect to the insertion direction of the rear side plate 52 into the rear bottom plate 51. In addition, a through-hole 51*n* penetrating the bent and raised portion 51*w*2 in a plate thickness direction (arrow Y direction) of the bent and raised portion 51*w*2 is formed in the bent and raised portion 51*w*2 of the rear bottom plate 51.

When the rear side plate 52 is assembled, the step-bent portions 52*m* and 52*p* of the rear side plate 52 are inserted into and engaged with the bent and raised portions 51*w*2 of the rear bottom plate 51. At this time, the inclined portions 52*m*1 and 52*p*1 of the rear side plate 52 abut on the bent and raised portions 51*w*2 of the rear bottom plate 51, such that movement of the rear side plate 52 in the arrow Z direction is guided. As a result, the bent and raised portion 51*w*2 of the rear bottom plate 51 is sandwiched from the plate thickness direction of the band and raised portion 51*w*2 by the step-bent portions 52*m* and 52*p*, and the flat surface portions 52*a* and the bent portion 52*b* in the rear side plate 52, such that a position of the rear side plate 52 with respect to the rear bottom plate 51 in the arrow X direction and the arrow Y direction is determined. In addition, the projection portion 52*n* of the rear side plate 52 engages with the through-hole 51*n* of the rear bottom plate 51. As a result, an edge portion 52*n*1 of the projection portion 52*n* abuts on an inner wall of the through-hole 51*n*, such that movement of the rear side plate 52 with respect to the rear bottom plate 51 in a direction opposite to the insertion direction is restricted. In addition, when the rear side plate 52 is inserted into the rear bottom plate 51 up to a position where a lower end portion of the rear side plate 52 abuts on a surface of the stand 33 on which the rear bottom plate 51 is placed or a position where portions of the step-bent portions 52*m* and 52*p* bent and raised from the flat surface portions 52*a* and the bent portion 52*b* abut on an upper end portion of the bent and raised portion 51*w*2 of the rear bottom plate 51, positions of the rear side plate 52 and the rear bottom plate 51 in the arrow Z direction are determined, such that a final relative position between the rear bottom plate 51 and the rear side plate 52 is determined.

Figure 7:
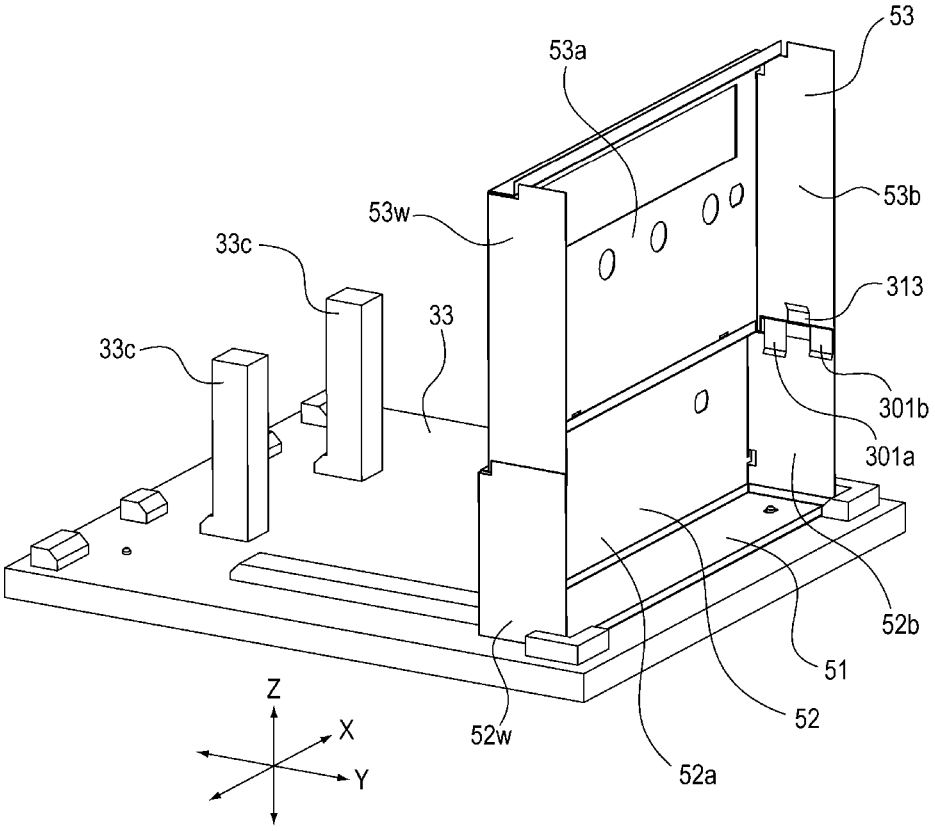
FIG. 7 is a perspective view when a rear side plate is assembled.
Figure 8A:
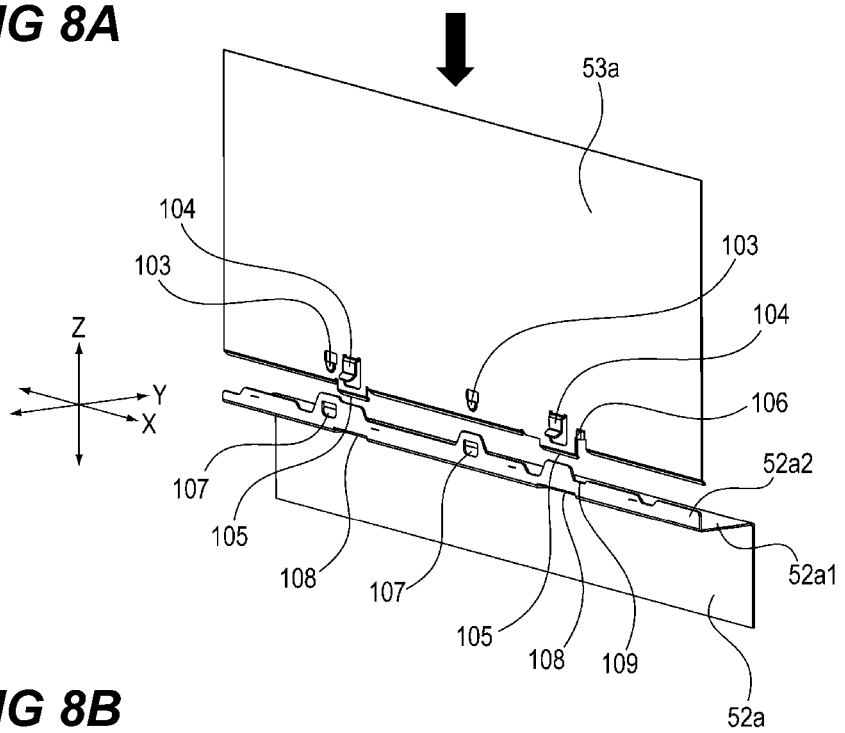
FIGS. 8A and 8B are perspective views of a support portion of the rear side plate.
Figure 8B:
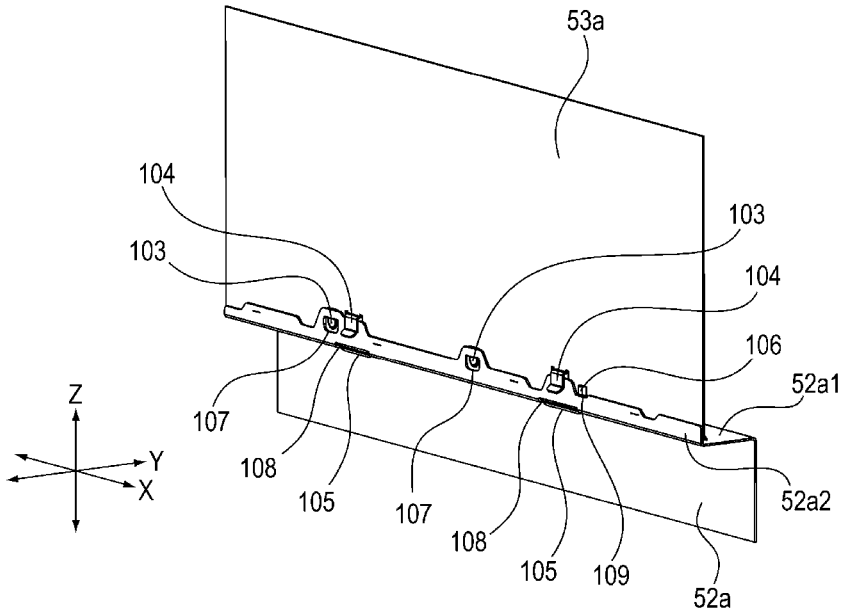
Figure 9A:
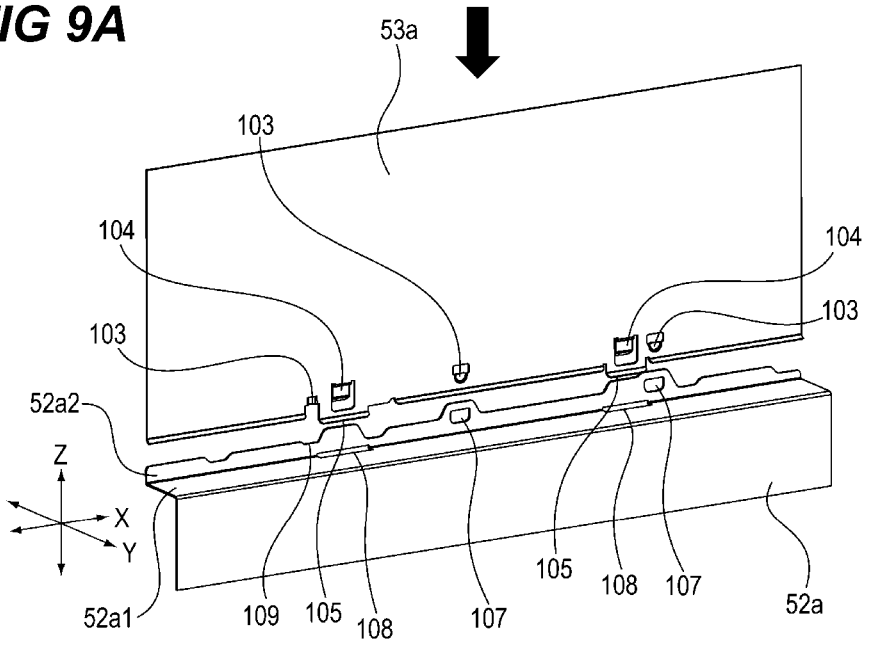
FIGS. 9A and 9B are perspective views of the support portion of the rear side plate.
Figure 9B:
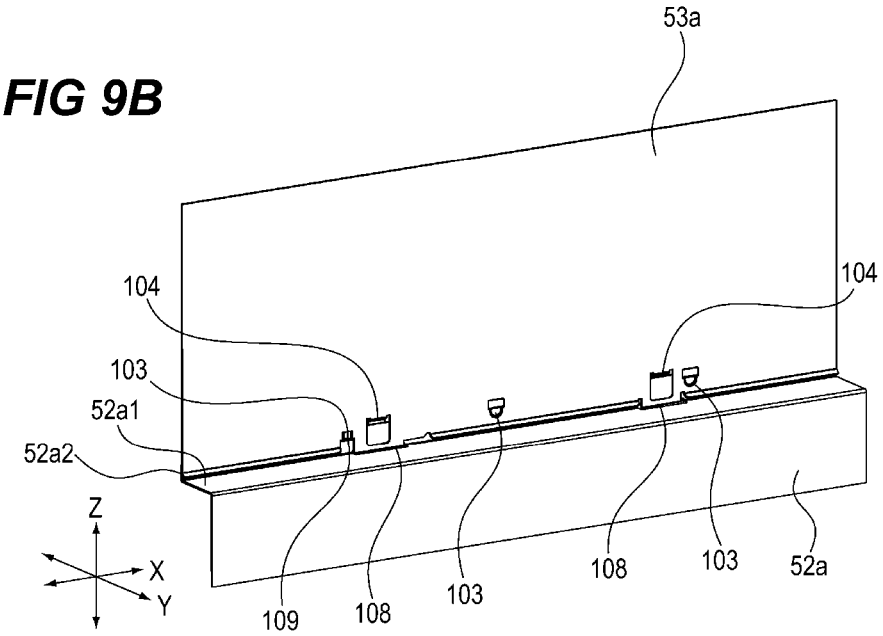
Figure 10A:
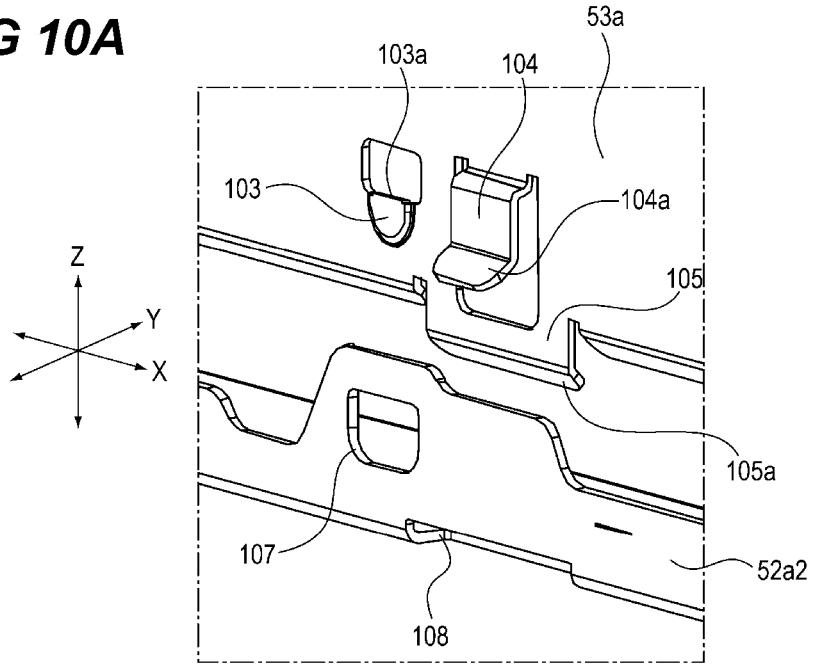
FIGS. 10A and 10B are perspective views of the support portion of the rear side plate.
Figure 10B:
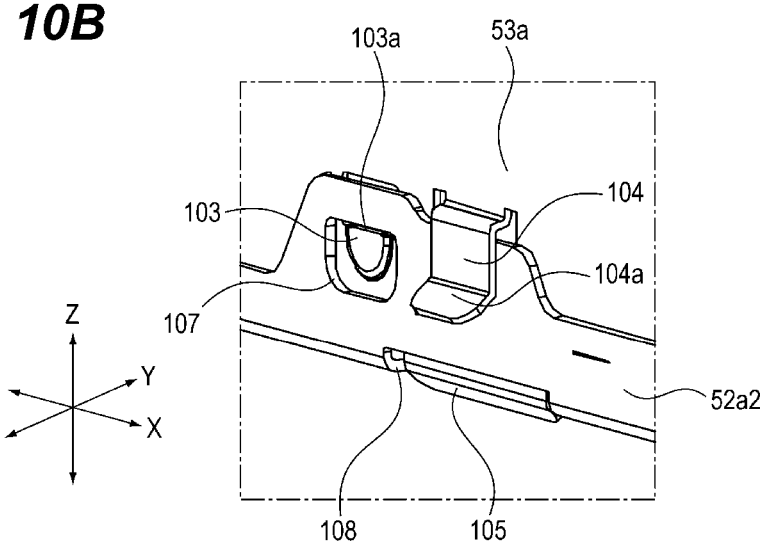
Figure 11A:
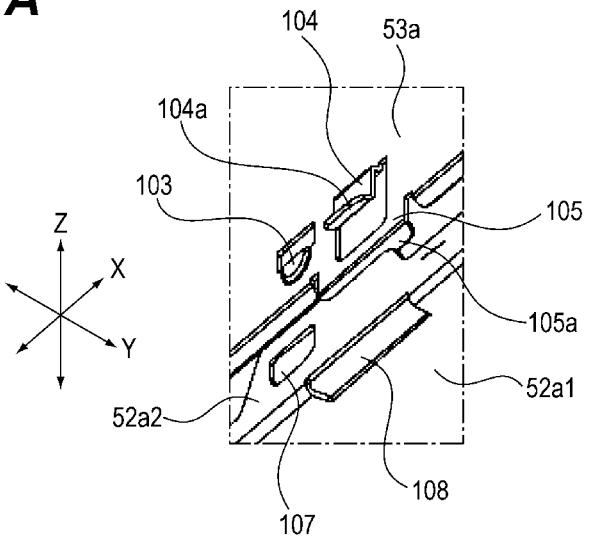
FIGS. 11A and 11B are perspective views of the support portion of the rear side plate.
Figure 11B:
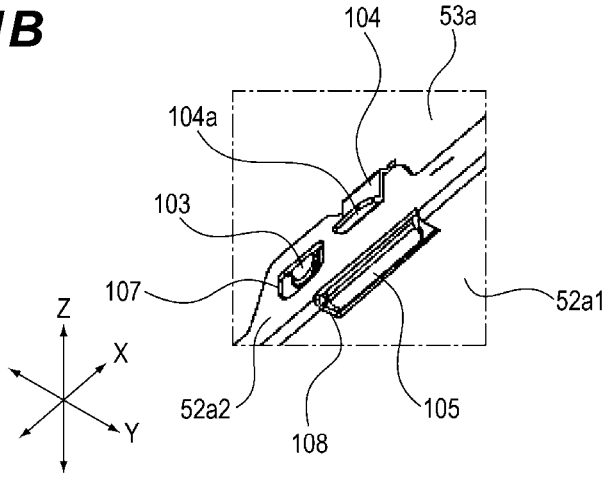

Next, as illustrated in FIG. 7, the rear side plate 53 is assembled. The rear side plate 53 supports the process cartridge 3 that has a large influence on image quality at the time of image formation. Therefore, it is particularly desirable that the rear side plate 53 is assembled with high position accuracy. Hereinafter, an assembly configuration of the rear side plate 53 will be described in detail.

As illustrated in FIG. 7, the rear side plate 53 is subjected to bending so as to have three flat surfaces. The rear side plate 53 is located on the rear side of the image forming apparatus A, and includes a support portion 53*a* supporting the process cartridge 3 and a bent portion 53*b* bent from the support portion 53*a* at a bending angle of a substantially right angle (89 to 90 degrees) and extending rearward of the image forming apparatus A. In addition, the rear side plate 53 includes a bent portion 53*w* bent with respect to the support portion 53*a* so as to face the bent portion 53*b*.

The support portion 53*a* of the rear side plate 53 is arranged adjacent to the flat surface portion 52*a* of the rear side plate 52 in the vertical direction, and the support portion 53*a* of the rear side plate 53 and the flat surface portion 52*a* of the rear side plate 52 are inserted and assembled into each other. The bent portion 53*b* of the rear side plate 53 is arranged adjacent to the bent portion 52*b* of the rear side plate 52 in the vertical direction, and the bent portion 53*b* of the rear side plate 53 and the bent portion 52*b* of the rear side plate 52 are inserted and assembled into each other. The bent portion 53*w* of the rear side plate 53 is arranged adjacent to the bent portion 52*w* of the rear side plate 52 in the vertical direction, and the bent portion 53*w* of the rear side plate 53 and the bent portion 52*w* of the rear side plate 52 are inserted and assembled into each other.

First, an assembly configuration of the flat surface portion 52*a* of the rear side plate 52 and the support portion 53*a* of the rear side plate 53 will be described. FIGS. 8A to 9B are perspective views of the flat surface portion 52*a* of the rear side plate 52 and the support portion 53*a* of the rear side plate 53. FIGS. 10A to 11B are enlarged perspective views of an engaging portion between the flat surface portion 52*a* of the rear side plate 52 and the support portion 53*a* of the rear side plate 53. Here, FIGS. 8A, 9A, 10A, and 11A illustrate a state before the rear side plate 52 and the rear side plate 53 are assembled to each other, and FIGS. 8B, 9B, 10B, and 11B illustrate a state where the rear side plate 52 and the rear side plate 53 are assembled to each other. In addition, FIGS. 8A, 8B, 10A, and 10B are views of the flat surface portion 52*a* and the support portion 53*a* when viewed from the inside of the frame 31 of the image forming apparatus A, and FIGS. 9A, 9B, 11A, and 11B are views of the flat surface portion 52*a* and the support portion 53*a* when viewed from the outside of the frame 31 of the image forming apparatus A.

As illustrated in FIGS. 8A to 11B, the support portion 53*a* of the rear side plate 53 (first support) is provided with two projection portions 103 protruding in a plate thickness direction of the rear side plate 53 and two step-bent portion 104 protruding in an insertion direction (arrow Z direction) of the rear side plate 53 into the rear side plate 52. In addition, two protrusion portions 105 protruding in the insertion direction of the rear side plate 53 into the rear side plate 52 (first support) are provided below the two step-bent portions 104.

The projection portion 103 is formed by drawing, and a protrusion amount of the projection portion 103 from a surface of the support portion 53*a* is about 0.3 mm to 2 mm. In addition, the projection portion 103 is arranged at a position adjacent to the step-bent portion 104 in a direction (arrow X direction) orthogonal to the plate thickness direction of the rear side plate 53 and the insertion direction of the rear side plate 53 into the rear side plate 52. The protrusion portion 105 is arranged below the step-bent portion 104 in the insertion direction of the rear side plate 53 into the rear side plate 52. A tip portion of the protrusion portion 105 is an inclined portion 105*a* inclined in a direction away from the support portion 53*a* with respect to the insertion direction of the rear side plate 53 into the rear side plate 52.

The step-bent portion 104 (first engaging portion) has a portion (first bent portion) bent in the plate thickness direction of the rear side plate 53 and a portion (second bent portion) bent and extended from that portion in the insertion direction of the rear side plate 53 into the rear side plate 52. In addition, a tip portion of the step-bent portion 104 is an inclined portion 104*a* (another inclined portion) inclined in a direction away from the support portion 53*a* with respect to the insertion direction of the rear side plate 53 into the rear side plate 52. Note that an interval between the two step-bent portions 104 of the rear side plate 53 in the arrow X direction is 100 mm or less.

A bent portion 52*a*1 bent in the arrow Y direction and a bent and raised portion 52*a*2 bent and raised from the bent portion 52*a*1 in the arrow Z direction are formed at an upper portion of the flat surface portion 52*a* of the rear side plate 52. Two through-holes 107 penetrating the bent and raised portion 52*a*2 in a plate thickness direction (arrow Y direction) of the bent and raised portion 52*a*2 are formed in the bent and raised portion 52*a*2. In addition, through-holes 108 penetrating a boundary portion between the bent portion 52*a*1 and the bent and raised portion 52*a*2 in a plate thickness direction thereof are formed at the boundary portion.

When the rear side plate 53 is assembled to the rear side plate 52, the inclined portion 104*a* of the step-bent portion 104 and the inclined portion 105*a* of the protrusion portion 105 of the rear side plate 53 abut on the bent and raised portion 52*a*2 of the rear side plate 52, such that movement of the rear side plate 53 in the arrow Z direction is guided. In addition, a stopper portion 106 of the rear side plate 53 abuts on an abutting portion 109, which is an upper end portion of the bent and raised portion 52*a*2 of the rear side plate 52, such that movement of the rear side plate 53 with respect to the rear side plate 52 in the insertion direction is restricted.

When the rear side plate 53 is assembled to the rear side plate 52, the step-bent portion 104 of the rear side plate 53 is inserted into the bent and raised portion 52*a*2 of the rear side plate 52, and engages with the bent and raised portion 52*a*2 of the rear side plate 52 so as to be hooked on the bent and raised portion 52*a*2. As a result, the bent and raised portion 52*a*2 of the rear side plate 52 is sandwiched from the plate thickness direction of the bent and raised portion 52*a*2 by the step-bent portion 104 and the support portion 53*a* in the rear side plate 53, such that a position of the rear side plate 53 with respect to the rear side plate 52 in the arrow Y direction is determined.

In addition, the projection portion 103 of the rear side plate 53 engages with the through-hole 107 of the rear side plate 52. As a result, an edge portion 103*a* of the projection portion 103 abuts on an inner wall of the through-hole 107, such that movement of the rear side plate 53 with respect to the rear side plate 52 in a direction opposite to the insertion direction is restricted. Note that in a process in which the rear side plate 53 is inserted into the rear side plate 52, the projection portion 103 presses the bent and raised portion 52*a*2 of the rear side plate 52 in a plate thickness direction of the bent and raised portion 52*a*2, such that the bent and raised portion 52*a*2 is elastically deformed. However, the projection portion 103 fits in the through-hole 107, such that the bent and raised portion 52*a*2 is no longer pressed in the plate thickness direction. Therefore, the bent and raised portion 52*a*2 is elastically deformed to returns to its original shape.

In addition, the protrusion portion 105 of the rear side plate 53 engages with the through-hole 108 of the rear side plate 52. As a result, the protrusion portion 105 abuts on an inner wall of the through-hole 108, such that movement of the rear side plate 53 respect to the rear side plate 52 in the arrow X direction is restricted.

As described above, the projection portion 52*n* that restricts the movement of the rear side plate 53 with respect to the rear side plate 52 in the direction opposite to the insertion direction is provided in the vicinity of the step-bent portion 104 that engages the rear side plate 52 and the rear side plate 53 with each other. As a result, it is possible to prevent the rear side plate 53 from moving with respect to the rear side plate 52 in the direction opposite to the insertion direction, such that the rear side plate 53 and the rear side plate 52 are separated from each other, resulting in deterioration of position accuracy. Therefore, the rear side plate 53 and the rear side plate 52 that constitute the frame 31 can be assembled to each other with high position accuracy.

Note that in the present embodiment, the projection portion 103 has been arranged at a position adjacent to the step-bent portion 104 in a direction (arrow X direction) orthogonal to a plate thickness direction (arrow Y direction) of the support portion 53*a* and the insertion direction (arrow Z direction) of the rear side plate 53 into the rear side plate 52. However, the present invention is not limited thereto. That is, even in a configuration in which the projection portion 103 is arranged at a position adjacent to the step-bent portion 104 in the insertion direction of the rear side plate 53 into the rear side plate 52, an effect similar to that described above can be obtained. In this case, in the present embodiment, the protrusion portion 105 is provided below the step-bent portion 104 in the insertion direction, and the projection portion 103 can thus be provided above the step-bent portion 104.

Figure 12A:
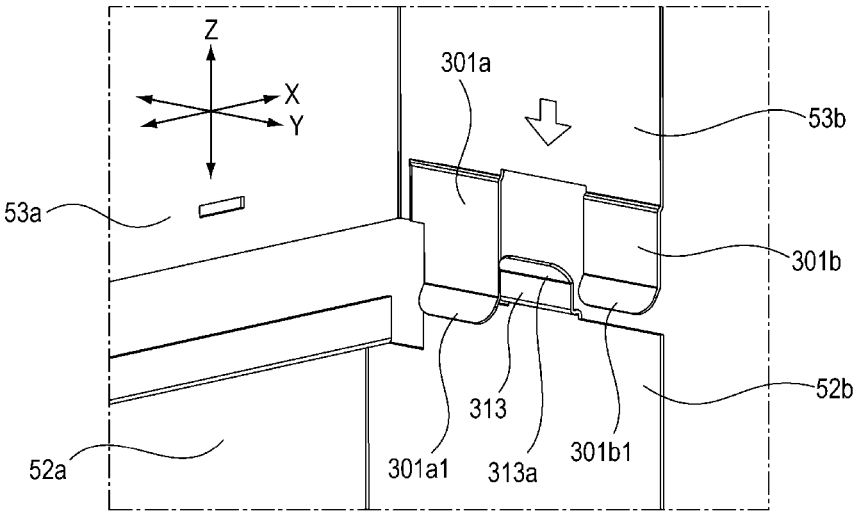
FIGS. 12A and 12B are perspective views of a bent portion of the rear side plate.
Figure 12B:
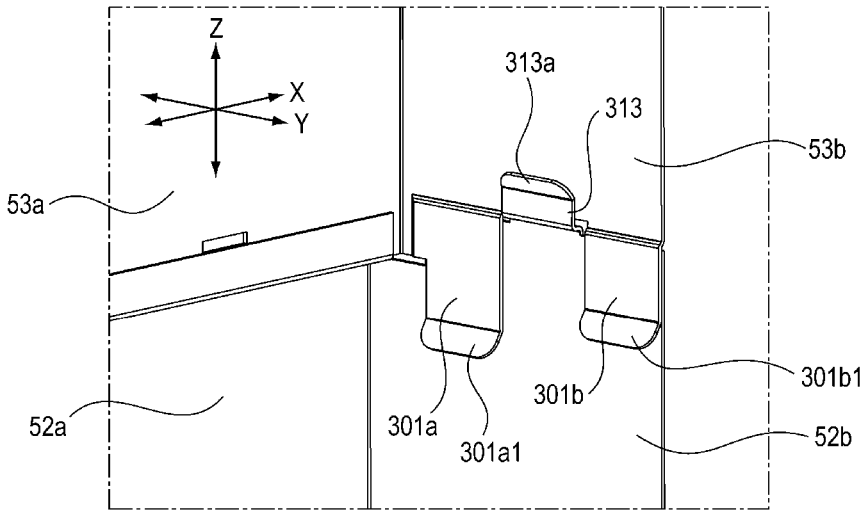

Next, an assembly configuration of the bent portion 52*b* of the rear side plate 52 and the bent portion 53*b* of the rear side plate 53 will be described. FIGS. 12A and 12B are enlarged perspective views of an engaging portion between the bent portion 52*b* of the rear side plate 52 and the bent portion 53*b* of the rear side plate 53. Here, FIG. 12A illustrates a state before the rear side plate 52 and the rear side plate 53 engage with each other, and FIG. 12B illustrates a state in which the rear side plate 52 and the rear side plate 53 engage with each other.

As illustrated in FIGS. 12A and 12B, the bent portion 53*b* of the rear side plate 53 and the bent portion 52*b* of the rear side plate 52 are inserted and assembled into each other. A step-bent portion 313 protruding in an insertion direction (arrow Z direction) into the bent portion 53*b* of the rear side plate 53 and inserted into and engaged with the bent portion 53*b* so as to overlap with the bent portion 53*b* of the rear side plate 53 in a plate thickness direction of the rear side plate 52 is provided at an upper portion of the bent portion 52*b* of the rear side plate 52. The step-bent portion 313 engages with the rear side plate 53 so as to be hooked on a lower end portion of the bent portion 53*b* of the rear side plate 53.

The step-bent portion 313 has a portion bent in the plate thickness direction (arrow X direction) of the bent portion 52*b* of the rear side plate 52 and a portion bent and extended from that portion in the insertion direction into the bent portion 53*b* of the rear side plate 53. In addition, a tip portion of the step-bent portion 313 is an inclined portion 313*a* that is formed to be bent from a portion of the step-bent portion 313 bent in the insertion direction into the bent portion 53*b* of the rear side plate 53 and is inclined in a direction away from the bent portion 52*b* with respect to the insertion direction into the bent portion 53*b*.

In addition, two protrusion portions 301*a* and 301*b* protruding in an insertion direction (arrow Z direction) into the bent portion 52*b* of the rear side plate 52 are provided at a lower portion of the bent portion 53*b* of the rear side plate 53. The protrusion portions 301*a* and 301*b* are inserted into and engaged with the bent portion 52*b* so as to overlap with the bent portion 52*b* of the rear side plate 52 in a plate thickness direction (arrow X direction) of the bent portion 53*b* of the rear side plate 53. In addition, the protrusion portions 301*a* and 301*b* engage with the bent portion 52*b* so as to be hooked on an upper end portion of the bent portion 52*b* of the rear side plate 52. In addition, tip portions of the protrusion portions 301*a* and 301*b* are inclined portions 301*a*1 and 301*b*1 inclined in a direction away from the bent portion 53*b* with respect to the insertion direction into the bent portion 52*b* of the rear side plate 52.

When the step-bent portion 313 engages with the bent portion 53*b* and the protrusion portions 301*a* and 301*b* engage with the bent portion 52*b*, the step-bent portion 313 and the protrusion portions 301*a* and 301*b* alternately perform engagement in a direction (arrow Y direction) orthogonal to the insertion direction and the plate thickness direction of the bent portions 52*b* and 53*b*. Specifically, the protrusion portion 301*a* is inserted into and engaged with the bent portion 52*b* on a side close to the support portion 53*a* of the rear side plate 53 with respect to the step-bent portion 313 and at a position adjacent to the step-bent portion 313, in the orthogonal direction. The protrusion portion 301*b* is inserted into and engaged with the bent portion 52*b* on a side distant from the support portion 53*a* of the rear side plate 53 with respect to the step-bent portion 313 and at a position adjacent to the step-bent portion 313, in the orthogonal direction. With such a configuration, the bent portion 52*b* of the rear side plate 52 and the bent portion 53*b* of the rear side plate 53 are firmly engaged with and assembled to each other.

Figure 13A:
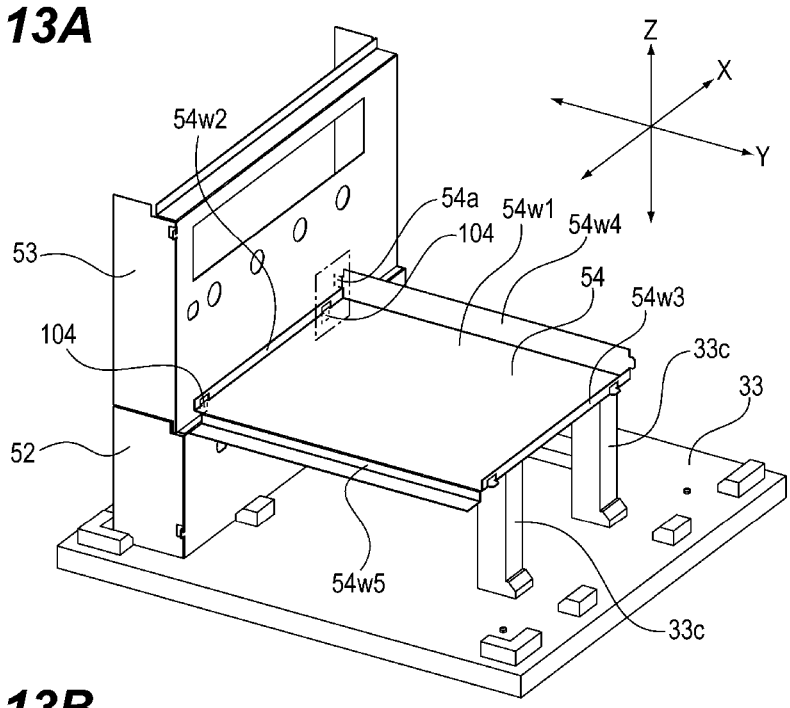
FIGS. 13A and 13B are perspective views when a middle stay is assembled.
Figure 13B:
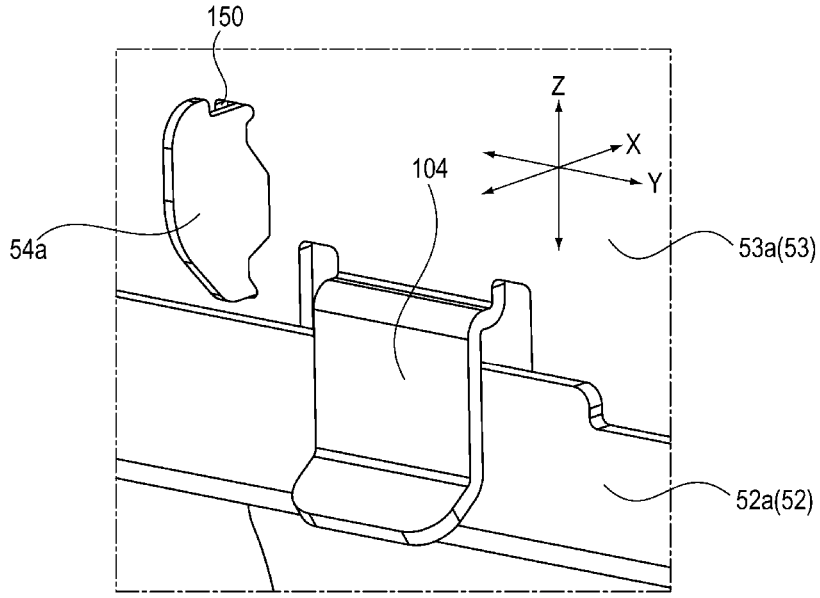

Next, as illustrated in FIGS. 13A and 13B, the middle stay 54 is assembled. The middle stay 54 is an optical stand on which the laser scanner unit 15 is placed. The middle stay 54 is arranged on two support columns 33*c* provided on the stand 33, and is inserted into the support portion 53*a* of the rear side plate 53.

The middle stay 54 has a flat surface portion 54*w*1 extending in the horizontal direction, and a bent and raised portion 54*w*2 bent and raised vertically and upward from the flat surface portion 54*w*1 at one end portion of the flat surface portion 54*w*1 in the arrow Y direction. In addition, the middle stay 54 has a bent and raised portion 54*w*3 bent vertically from the flat surface portion 54*w*1 so as to face the bent and raised portion 54*w*2 and a bent and raised portion 54*w*4 bent vertically and upward from the flat surface portion 54*w*1 at one end portion of the flat surface portion 54*w*1 in the arrow X direction. In addition, the middle stay 54 has a bent portion 54*w*5 bent vertically and downward from the flat surface portion 54*w*1 at the other end portion of the flat surface portion 54*w*1 in the arrow X direction and further extending in the horizontal direction. The bent and raised portion 54*w*4 of the middle stay 54 is provided with a protrusion portion 54*a* protruding in an insertion direction (arrow Y direction) into the rear side plate 53. The protrusion portion 54*a* of the middle stay 54 is inserted into a through-hole 150 formed in the support portion 53*a* of the rear side plate 53 and penetrating the support portion 53*a* in a plate thickness direction (arrow Y direction) of the support portion 53*a*. As a result, a position of the middle stay 54 with respect to the rear side plate 53 in the arrow X direction and the arrow Y direction is determined.

Figure 14A:
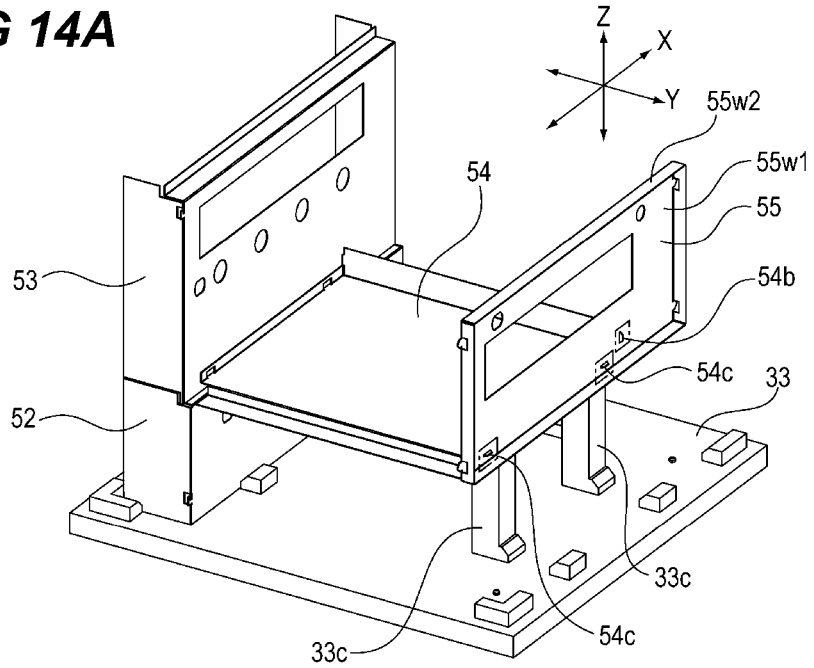
FIGS. 14A to 14C are perspective views when a front side plate is assembled.
Figure 14B:
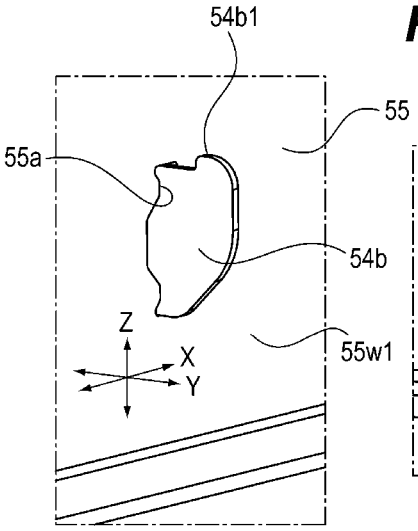
Figure 14C:
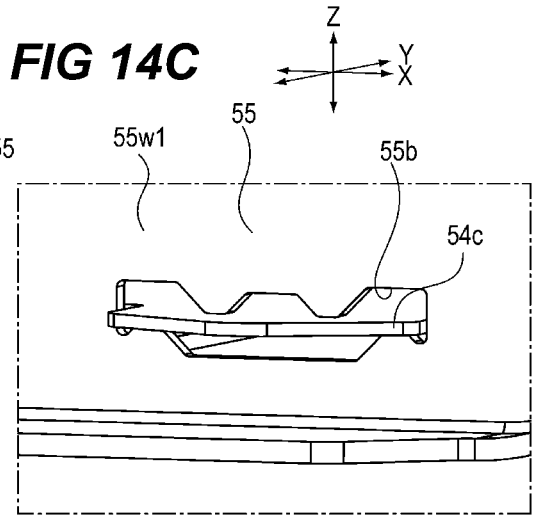

Next, as illustrated in FIGS. 14A to 14C, the front side plate 55 is assembled. The middle stay 54 is inserted into the front side plate 55. The front side plate 55 has a flat surface portion 55*w*1 extending in the vertical direction and a bent and raised portion 55*w*2 bent and raised from each of both end portions of the flat surface portion 55*w*1 in the arrow X direction and the arrow Z direction forward of the image forming apparatus A. Through-holes 55*a* and 55*b* penetrating through the flat surface portion 55*w*1 in a plate thickness direction (arrow Y direction) of the flat surface portion 55*w*1 are formed in the flat surface portion 55*w*1 of the front side plate 55. In addition, the bent and raised portion 54*w*3 of the middle stay 54 is provided with protrusion portions 54*b* and 54*c* protruding in an insertion direction (arrow Y direction) into the front side plate 55. A tip portion of the protrusion portion 54*b* is provided with a hook portion 54*b*1 protruding upward of a base end portion.

The protrusion portion 54*b* of the middle stay 54 is inserted into the through-hole 55*a* formed in the flat surface portion 55*w*1 of the front side plate 55, and the protrusion portion 54*c* of the middle stay 54 is inserted into the through-hole 55*b* formed in the flat surface portion 55*w*1 of the front side plate 55. As a result, a position of the front side plate 55 with respect to the middle stay 54 is determined. In addition, the hook portion 54*b*1 of the protrusion portion 54*b* faces an upper portion of the through-hole 55*a* in the front side plate 55. As a result, the hook portion 54*b*1 of the middle stay 54 abuts on the flat surface portion 55*w*1 of the front side plate 55, such that movement of the middle stay 54 with respect to the front side plate 55 in a direction opposite to the insertion direction is restricted and the middle stay 54 is prevented from coming off.

Figure 15A:
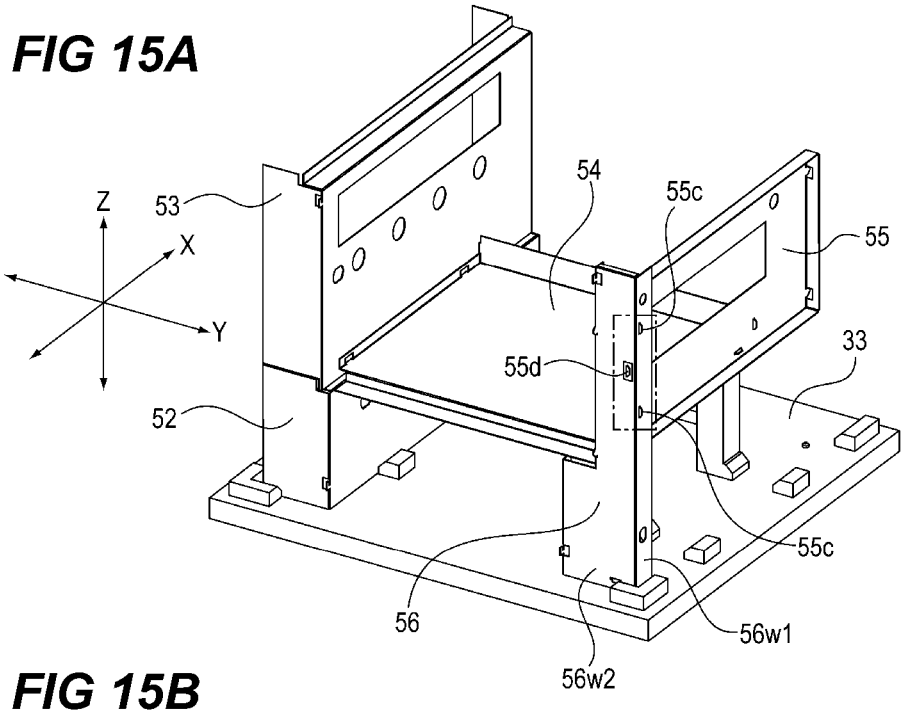
FIGS. 15A and 15B are perspective views when a left support column is assembled.
Figure 15B:
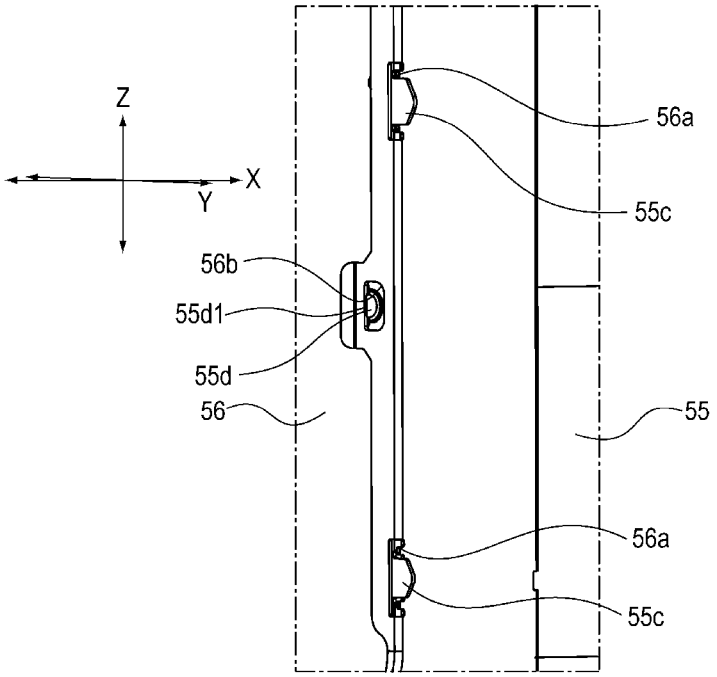

Next, as illustrated in FIGS. 15A and 15B, the left support column 56 is assembled. The left support column 56 is arranged on the stand 33. In addition, the front side plate 55 is inserted into the left support column 56. The left support column 56 is mainly formed of two flat surfaces, and has a flat surface portion 56*w*1 extending in parallel with the flat surface portion 55*w*1 of the front side plate 55 and a flat surface portion 56*w*2 bent substantially vertically from the flat surface portion 56*w*1 rearward of the image forming apparatus A. A bent portion of a boundary between the flat surface portion 56*w*1 and the flat surface portion 56*w*2 of the left support column 56 is provided with through-holes 56*a* penetrating the bent portion in the arrow Y direction. In addition, the flat surface portion 56*w*2 of the left support column 56 is provided with a through-hole 56*b* penetrating the flat surface portion 56*w*2 in a plate thickness direction (arrow X direction) of the flat surface portion 56*w*2. In addition, the bent and raised portion 55*w*2 of the front side plate 55 is provided with protrusion portions 55*c* protruding in an insertion direction (arrow Y direction) into the left support column 56 and a projection portion 55*d* protruding in a plate thickness direction (arrow X direction).

The protrusion portion 55*c* of the front side plate 55 is inserted into the through-hole 56*a* formed in the left support column 56. As a result, a position of the left support column 56 with respect to the front side plate 55 is determined. In addition, the projection portion 55*d* of the front side plate 55 engages with the through-hole 56*b* of the left support column 56. As a result, an edge portion 55*d*1 of the projection portion 55*d* abuts on an inner wall of the through-hole 56*b*, such that movement of the front side plate 55 with respect to the left support column 56 in a direction opposite to the insertion direction is restricted.

Figure 16A:
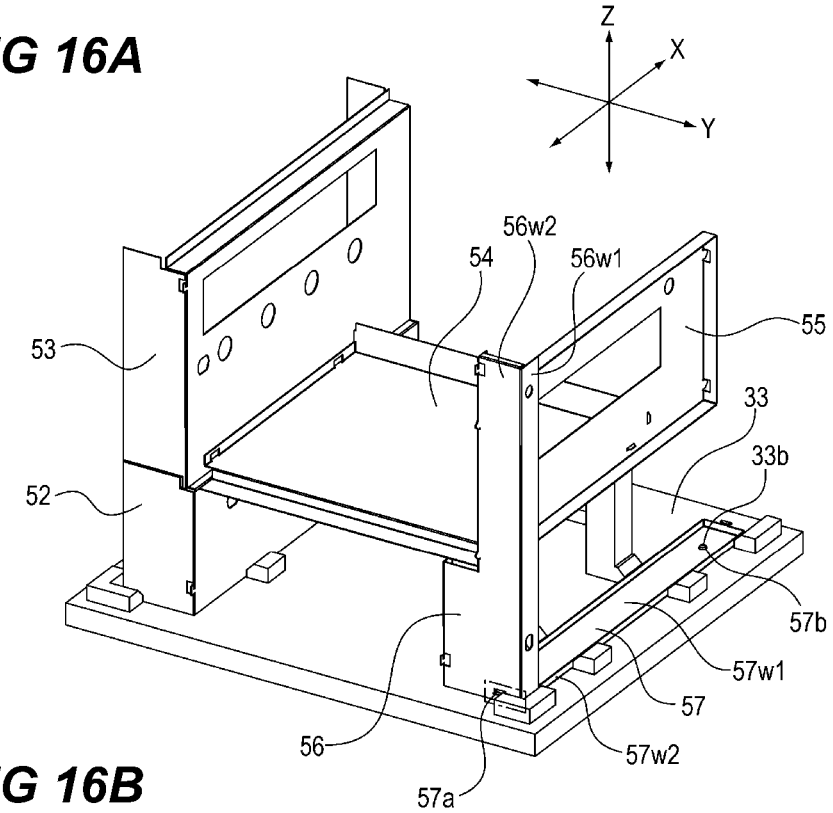
FIGS. 16A and 16B are perspective views when a front lower stay is assembled.
Figure 16B:
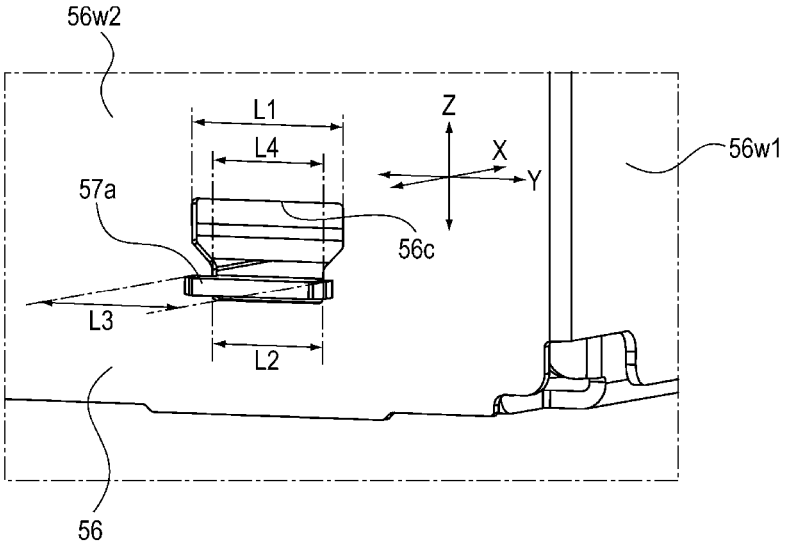

Next, as illustrated in FIGS. 16A and 16B, the front lower stay 57 is assembled. The front lower stay 57 is arranged on the stand 33, and is inserted and assembled into the left support column 56. The front lower stay 57 has a flat surface portion 57*w*1, which is a flat surface to be placed on the stand 33, and a bent and raised portion 57*w*2 formed by bending and raising each of both end portions of the flat surface portion 57w1 in the arrow X direction and the arrow Y direction substantially vertically and upward from the flat surface portion 57w1. The bent and raised portion 57w2 of the front lower stay 57 is provided with a protrusion portion 57a protruding in an insertion direction (arrow X direction) into the left support column 56. Positioning holes 57b penetrating the flat surface portion 57w1 in a plate thickness direction (arrow Z direction) of the flat surface portion 57w1 are formed in the flat surface portion 57w1 of the front lower stay 57. In addition, a through-hole 56c penetrating the flat surface portion 56w2 in a plate thickness direction (arrow X direction) of the flat surface portion 56w2 is formed in the flat surface portion 56w2 of the left support column 56. Here, a width of an upper end portion of the through-hole 56c is L1 and a width of a lower end portion of the through-hole 56c is L2. In addition, a width of a tip portion of the protrusion portion 57a is L3 and a width of a base plate portion of the protrusion portion 57a is L4. At this time, relationships of L1>L2, L4<L3, L1≈L3, and L2≈L4 are satisfied.

The protrusion portion 57a of the front lower stay 57 is inserted into and engaged with a through-hole 56c formed in the flat surface portion 56w2 of the left support column 56. At this time, the protrusion portion 57a is inserted from an upper side of the through-hole 56c, and then moved to the lower end portion of the through-hole 56c by the force or gravity of an assembly operator. Here, when the protrusion portion 57a is located at a lower end portion of the through-hole 56c, movement of the protrusion portion 57a with respect to the through-hole 56c in a direction opposite to the insertion direction is restricted by the relationship of L3>L2. In addition, when the front lower stay 57 is arranged on the stand 33, the positioning pins 33b of the stand 33 are inserted into the positioning holes 57b of the front lower stay 57. As a result, a position of the front lower stay 57 with respect to the stand 33 is determined.

Figure 17:
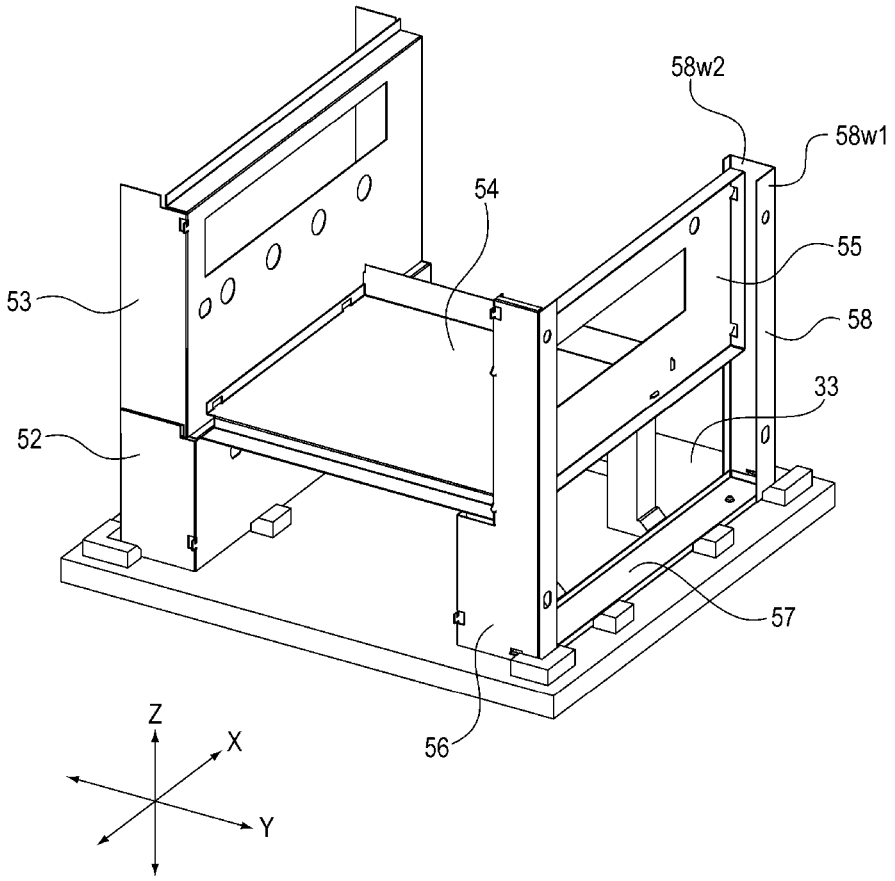
FIG. 17 is a perspective view when a right support column is assembled.

Next, as illustrated in FIG. 17, the right support column 58 is assembled. The right support column 58 is arranged on the stand 33. In addition, the front side plate 55 is inserted and assembled into the right support column 58. The right support column 58 has a flat surface portion 58w1 extending in parallel with the flat surface portion 55w1 of the front side plate 55 and a flat surface portion 58w2 bent substantially vertically from the flat surface portion 58w1 forward of the image forming apparatus A. An assembly configuration of the right support column 58 and the front side plate 55 is similar to that of the left support column 56 and the front side plate 55. That is, a through-hole (not illustrated) penetrating a bent portion of a boundary between the flat surface portion 58w1 and the flat surface portion 58w2 of the right support column 58 in the arrow Y direction is formed in the bend portion. A protrusion portion (not illustrated) formed in the bent and raised portion 55w2 of the front side plate 55 and protruding in an insertion direction (arrow Y direction) into the right support column 58 is inserted into this through-hole. In addition, a through-hole (not illustrated) penetrating the flat surface portion 58w2 in a plate thickness direction (arrow X direction) of the flat surface portion 58w2 is formed in the flat surface portion 58w2 of the right support column 58. A projection portion (not illustrated) formed in the bent and raised portion 55w2 of the front side plate 55 and protruding in the arrow X direction engages with this through-hole.

At a point in time when the frame 31 is assembled up to now, the frame 31 can stand for oneself. That is, the frame 31 can stand for oneself by assembling the front side plate 55, the right support column 58, the left support column 56, the front lower stay 57, which are the frame 31 on the front surface side of the image forming apparatus A, the rear bottom plate 51 and the rear side plates 52 and 53, which are the frame on the rear surface side of the image forming apparatus A, and the middle stay 54, which is the frame 31 connecting the frame on the front surface side and the frame on the rear surface side to each other, to each other.

Figure 18A:
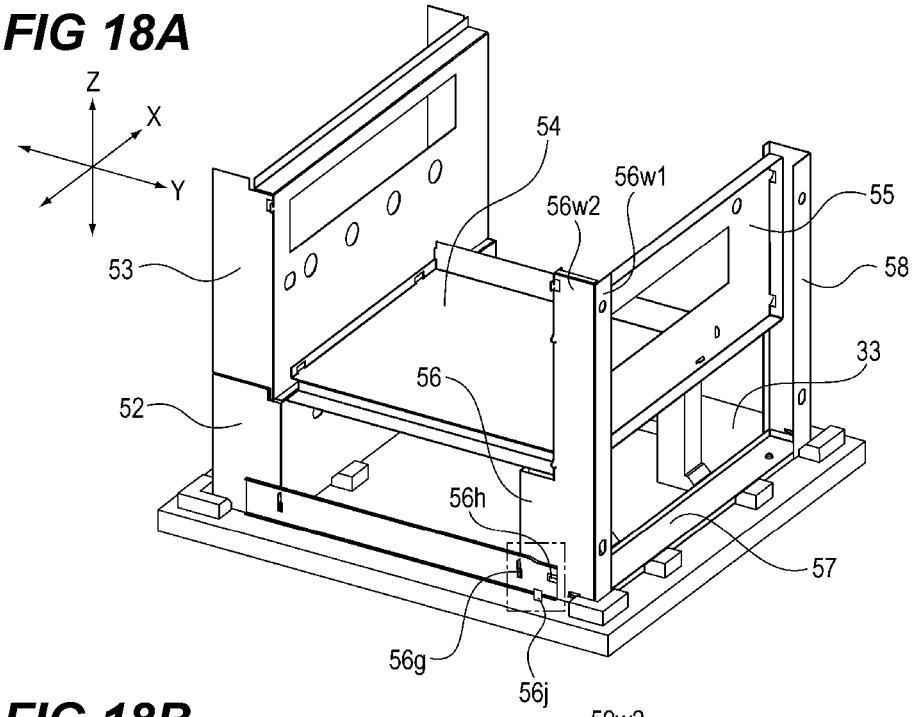
FIGS. 18A and 18B are perspective views when a left lower stay is assembled.
Figure 18B:
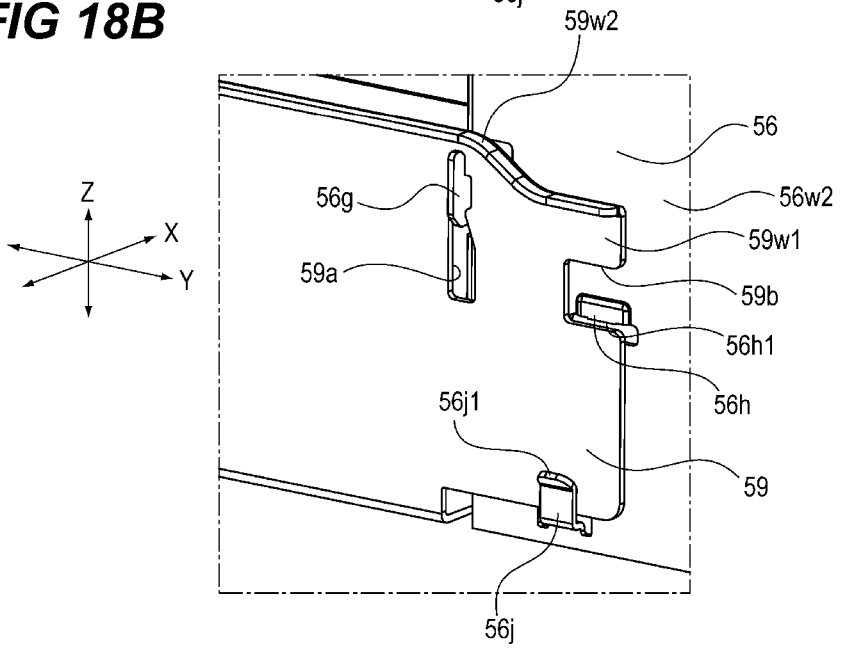

Next, as illustrated in FIGS. 18A and 18B, the left lower stay 59 is assembled. The left lower stay 59 has a flat surface portion 59w1 extending in parallel with the flat surface portion 56w2 of the left support column 56 and a bent and raised portion 59w2 bent and raised in a plate thickness direction (arrow X direction) of the flat surface portion 59w1 at an upper portion of the flat surface portion 59w1. The left lower stay 59, and the rear side plate 52 and the left support column 56 are inserted and assembled into each other from the vertical direction. An assembly configuration of the left lower stay 59 and the left support column 56 and an assembly configuration of the left lower stay 59 and the rear side plate 52 are similar to each other. Therefore, only the assembly configuration of the left lower stay 59 and the left support column 56 will be described here.

The flat surface portion 56w2 of the left support column 56 is provided with a protrusion portion 56g and a step-bent portion 56j that protrude in an insertion direction (arrow Z direction) into the left lower stay 59 and a projection portion 56h that protrudes in a plate thickness direction (arrow X direction) of the flat surface portion 56w2. The step-bent portion 56j has a portion bent in the plate thickness direction of the flat surface portion plate 56w2 and a portion bent and extended from that portion in the insertion direction into the left lower stay 59. In addition, a tip portion of the step-bent portion 56j is an inclined portion 56j1 inclined in a direction away from the flat surface portion 56w2 with respect to the insertion direction of the left support column 56 into the left lower stay 59. In addition, a through-hole 59a penetrating the flat surface portion 59w1 in the plate thickness direction (arrow X direction) of the flat surface portion 59w1 and a notch portion 59b notched in the flat surface direction of the flat surface portion 59w1 are formed in the flat surface portion 59w1 of the left lower stay 59.

The protrusion portion 56g of the left support column 56 is inserted into and engaged with the through-hole 59a formed in the flat surface portion 59w1 of the left lower stay 59. Here, a width of the protrusion portion 56g in the arrow Y direction and a width of the through-hole 59a in the arrow Y direction are substantially the same as each other. Therefore, the protrusion portion 56g is inserted into the through-hole 59a, such that a position of the left lower stay 59 with respect to the left support column 56 in the arrow Y direction is determined.

In addition, the step-bent portion 56j of the left support column 56 is inserted into and engaged with a lower end portion of the flat surface portion 59w1 of the left lower stay 59. As a result, the flat surface portion 59w1 of the left lower stay 59 is sandwiched from the plate thickness direction (arrow X direction) of the flat surface portion 59w1 by the step-bent portion 56j and the flat surface portion 56w2 in the left support column 56, such that a position of the left lower stay 59 with respect to the left support column 56 in the arrow X direction is determined.

In addition, the projection portion 56h of the left support column 56 engages with the notch portion 59b formed in the left lower stay 59. As a result, an edge portion 56h1 of the projection portion 56h abuts on an inner wall of the notch portion 59b, such that movement of the left support column 56 with respect to the left lower stay 59 in a direction opposite to the insertion direction is restricted.

Figure 19A:
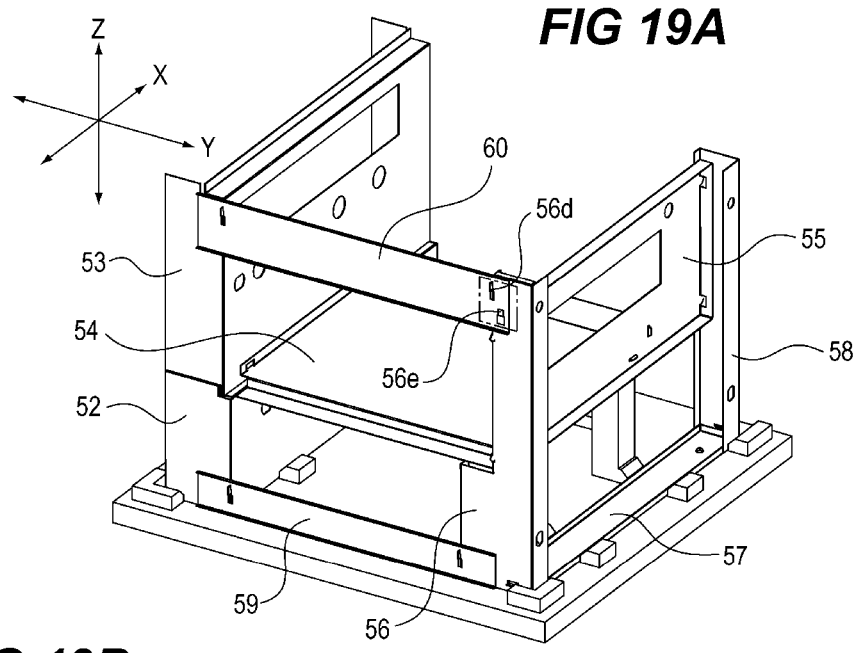
FIGS. 19A and 19B are perspective views when a left upper stay is assembled.
Figure 19B:
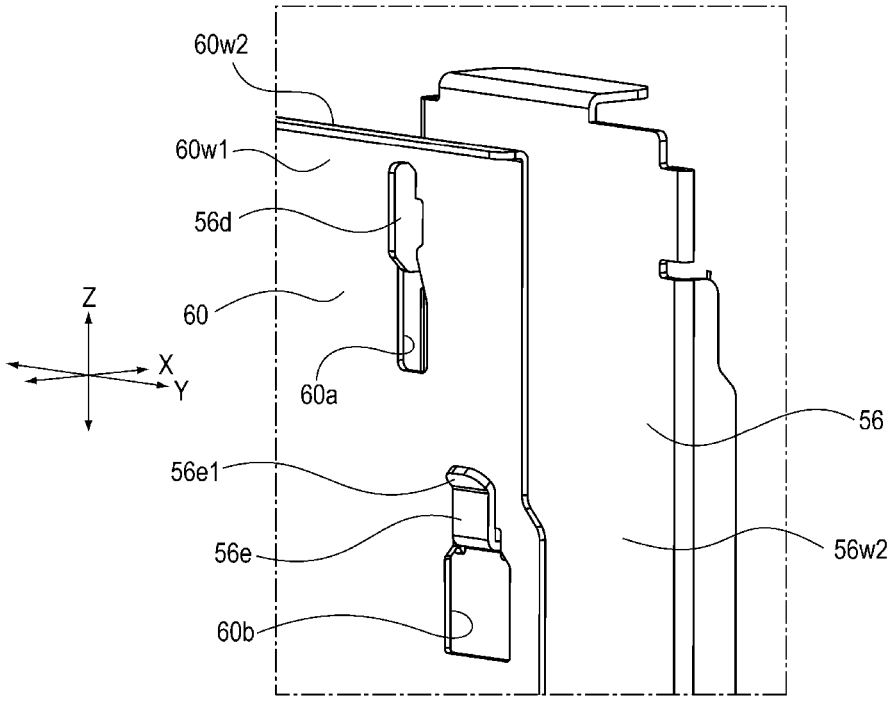

Next, as illustrated in FIGS. 19A and 19B, the left upper stay 60 is assembled. The left lower stay 59, and the rear side plate 53 and the left support column 56 are inserted and assembled into each other from the vertical direction. An assembly configuration of the left upper stay 60 and the rear side plate 53 and an assembly configuration of the left upper stay 60 and the left support column 56 are similar to each other. Therefore, only the assembly configuration of the left upper stay 60 and the left support column 56 will be described here.

A protrusion portion 56*d* and a step-bent portion 56*e* that protrude in an insertion direction (arrow Z direction) into the left upper stay 60 are formed in the flat surface portion 56*w*2 of the left support column 56. The step-bent portion 56*e* has a portion bent in the plate thickness direction (arrow X direction) of the flat surface portion plate 56*w*2 of the left support column 56 and a portion bent and extended from that portion in the insertion direction into the left upper stay 60. In addition, a tip portion of the step-bent portion 56*e* is an inclined portion 56*e*1 inclined in a direction away from the flat surface portion 56*w*2 with respect to the insertion direction of the left support column 56 into the left upper stay 60.

The left upper stay 60 has a flat surface portion 60*w*1 extending in parallel with the flat surface portion 56*w*2 of the left support column 56 and a bent and raised portion 60*w*2 bent and raised in a plate thickness direction (arrow X direction) of the flat surface portion 60*w*1 at an upper portion of the flat surface portion 60*w*1. Through-holes 60*a* and 60*b* penetrating through the flat surface portion 60*w*1 in the plate thickness direction (arrow X direction) of the flat surface portion 60*w*1 are formed in the flat surface portion 60*w*1 of the left upper stay 60.

The protrusion portion 56*d* of the left support column 56 is inserted into and engaged with the through-hole 60*a* formed in the flat surface portion 60*w*1 of the left upper stay 60. Here, a width of the protrusion portion 56*d* in the arrow Y direction and a width of the through-hole 60*a* in the arrow Y direction are substantially the same as each other. Therefore, the protrusion portion 56*d* is inserted into the through-hole 60*a*, such that a position of the left upper stay 60 with respect to the left support column 56 in the arrow Y direction is determined. In addition, the step-bent portion 56*e* of the left support column 56 is inserted into and engaged with the through-hole 60*b* of the left upper stay 60. As a result, the flat surface portion 60*w*1 of the left upper stay 60 is sandwiched from the plate thickness direction (arrow X direction) of the flat surface portion 60*w*1 by the step-bent portion 56*e* and the flat surface portion 56*w*2 in the left support column 56, such that a position of the left upper stay 60 with respect to the left support column 56 in the arrow X direction is determined.

Figure 20:
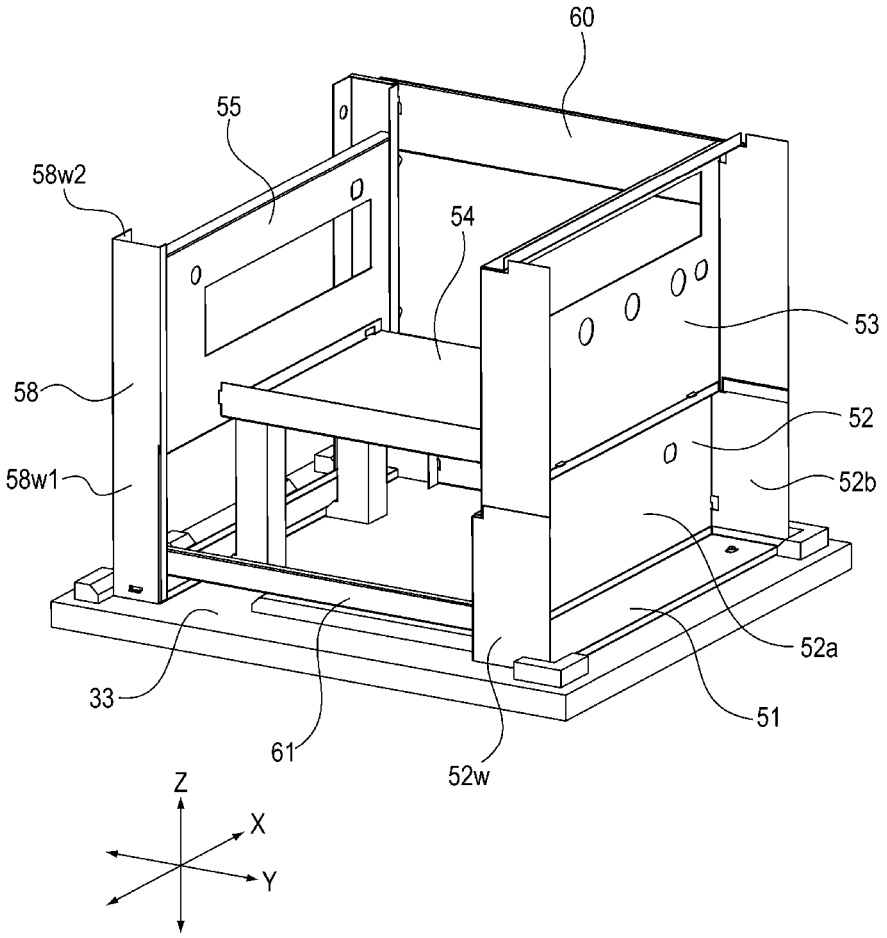
FIG. 20 is a perspective view when a right lower stay is assembled.

Next, as illustrated in FIG. 20, the right lower stay 61 is assembled. The right lower stay 61 is a member connecting between the rear side plate 52 and the right support column 58 facing each other, and is inserted and assembled into the rear side plate 52 and the right support column 58 from the horizontal direction (arrow Y direction) and the same direction. The right lower stay 61 is a member that guarantees a conveyance property of the sheet S. In addition, since the right lower stay 61 is located in the vicinity of a corner of the frame 31, the right lower stay 61 has an influence on rigidity of the frame 31. Therefore, it is particularly desirable that the right lower stay 61 is assembled with high position accuracy. Hereinafter, an assembly configuration of the right lower stay 61 will be described in detail.

Figure 21A:
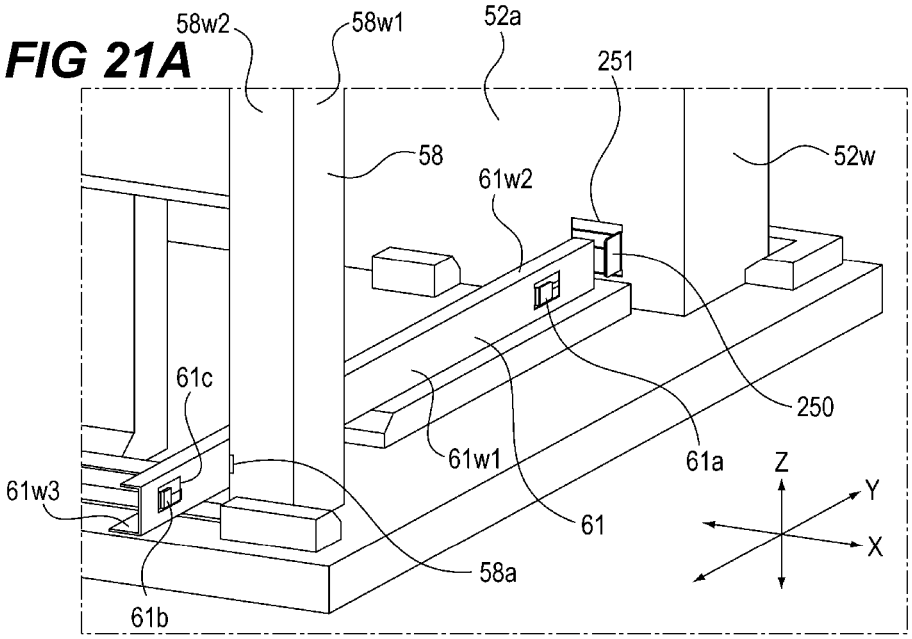
FIGS. 21A and 21B are perspective views of the right lower stay, the rear side plate, and the right support column.
Figure 21B:
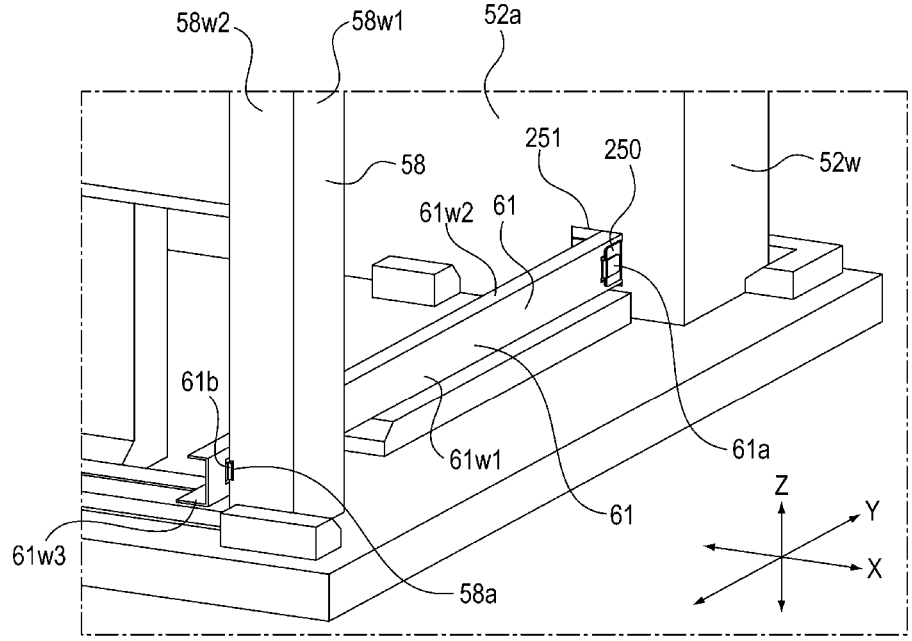
Figure 22A:
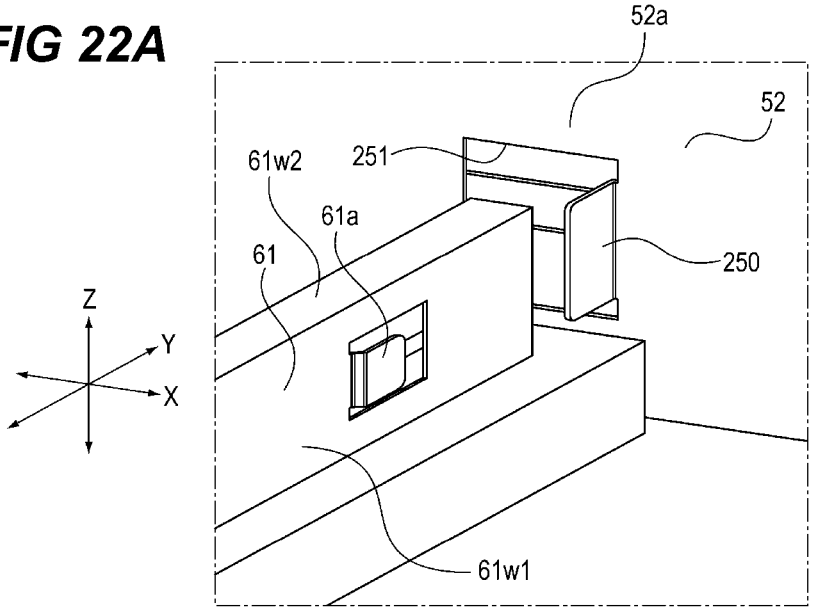
FIGS. 22A and 22B are enlarged perspective views of an engaging portion between the right lower stay and the rear side plate.
Figure 22B:
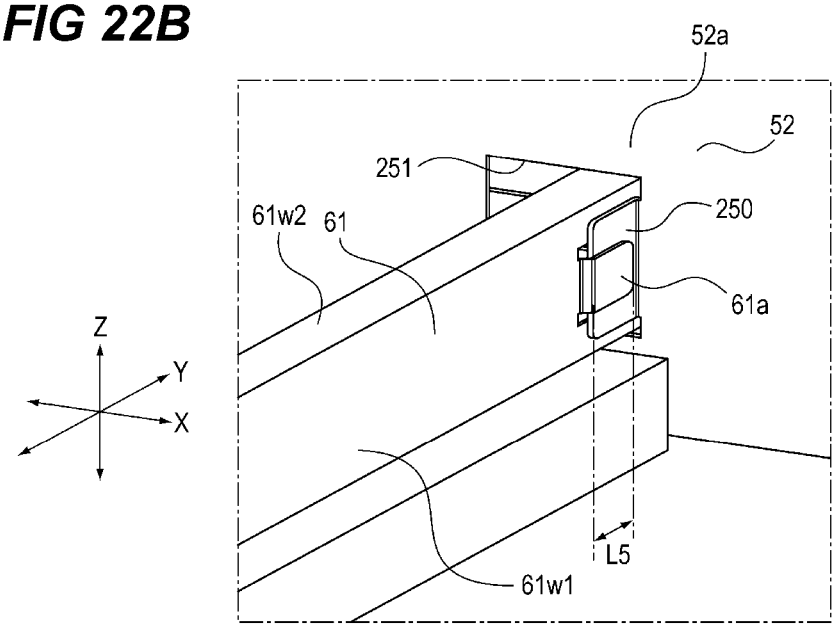
Figure 23A:
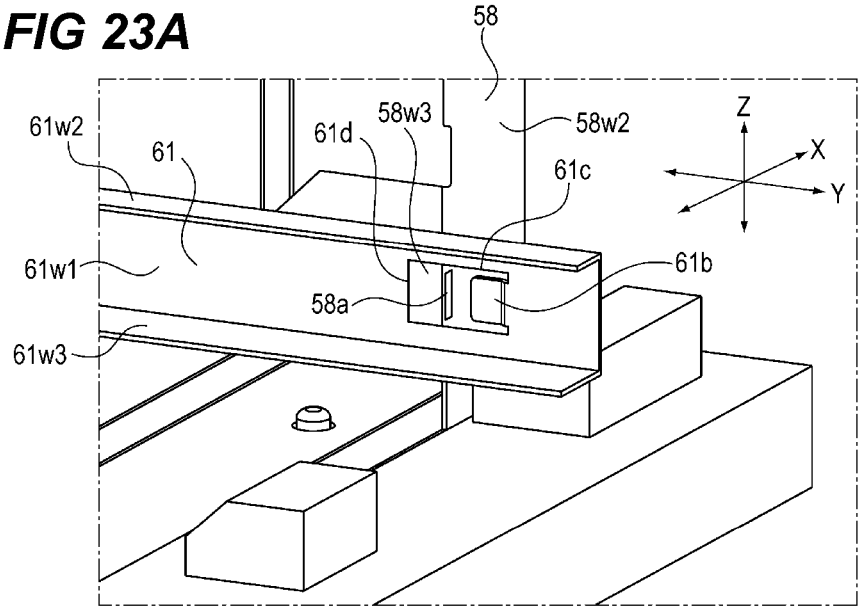
FIGS. 23A and 23B are enlarged perspective views of an engaging portion between the right lower stay and the right support column.
Figure 23B:
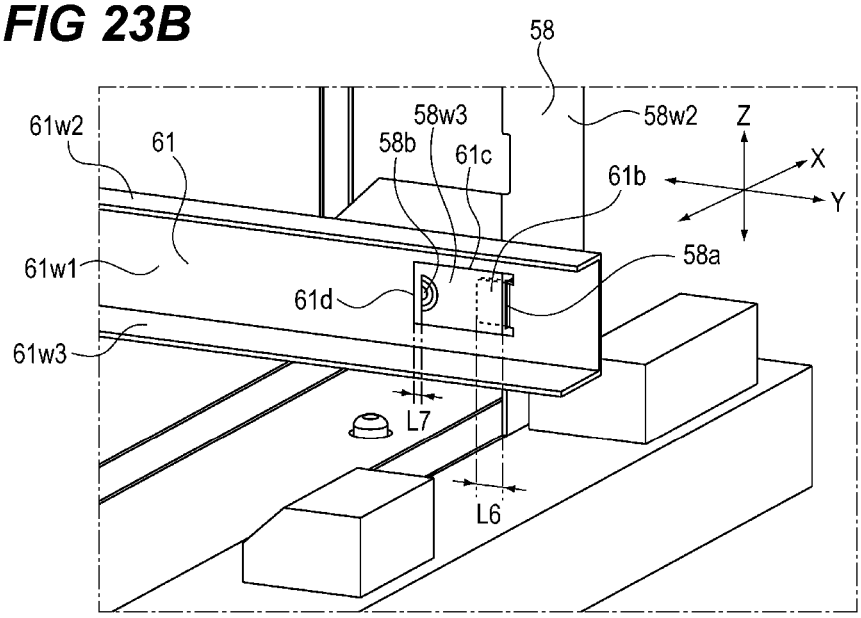

FIGS. 21A and 21B are perspective views of the right lower stay 61, the rear side plate 52, and the right support column 58. FIGS. 22A and 22B are enlarged perspective views of an engaging portion between the right lower stay 61 and the rear side plate 52. FIGS. 23A and 23B are enlarged perspective views of an engaging portion between the right lower stay 61 and the right support column 58. Here, FIGS. 21A, 22A, and 23A illustrate a state before the right lower stay 61 is assembled, and FIGS. 21B, 22B, and 23B illustrate a state where the right lower stay 61 is assembled.

First, an assembly configuration of the right lower stay 61 and the rear side plate 52 will be described. As illustrated in FIGS. 21A, 21B, 22A, and 22B, the flat surface portion 52*a* of the rear side plate 52 is provided with a bent portion 250 bent and raised in the arrow Y direction. In addition, a through-hole 251 penetrating the flat surface portion 52*a* in the plate thickness direction (arrow Y direction) of the flat surface portion 52*a* is formed around the bent portion 250, in the flat surface portion 52*a* of the rear side plate 52. As described above, the rear side plate 52 is formed of one sheet metal, and the through-hole 251 is a hole formed when the bent portion 250 is formed.

The right lower stay 61 includes three flat surfaces. The right lower stay 61 has a flat surface portion 61*w*1 extending substantially in parallel with the bent portion 52*w* of the rear side plate 52 and a flat surface portion 61*w*2 bent substantially vertically from the flat surface portion 61*w*1 in the arrow X direction at an upper portion of the flat surface portion 61*w*1. In addition, the right lower stay 61 has a flat surface portion 61*w*3 bent so as to face the flat surface portion 61*w*2 at a lower portion of the flat surface portion 61*w*1. The flat surface portion 61*w*1 of the right lower stay 61 is provided with a step-bent portion 61*a* inserted into and engaged with the bent portion 250 of the rear side plate 52. The step-bent portion 61*a* has a portion bent in a plate thickness direction (arrow X direction) of the flat surface portion plate 61*w*1 of the right lower stay 61 and a portion bent and extended from that portion in an insertion direction (arrow Y direction) into the rear side plate 52.

When the right lower stay 61 is assembled, the entirety of one end portion of the right lower stay 61 in the arrow Y direction is inserted into the through-hole 251 of the rear side plate 52, and the step-bent portion 61*a* of the right lower stay 61 is inserted into and engaged with the bent portion 250 of the rear side plate 52. As a result, the bent portion 250 of the rear side plate 52 is sandwiched from the plate thickness direction (arrow X direction) of the bent portion 250 by the step-bent portion 61*a* and the flat surface portion 61*w*1 in the right lower stay 61, such that a position of the right lower stay 61 with respect to the rear side plate 52 in the arrow X direction is determined.

In addition, the flat surface portion 61*w*2, which is an upper surface of the right lower stay 61, and an inner wall of an upper side of the through-hole 251 of the rear side plate 52 face each other with a predetermined interval therebetween, and the flat surface portion 61*w*3, which is a lower surface of the right lower stay 61, and an inner wall of a lower side of the through-hole 251 of the rear side plate 52 face each other with a predetermined interval therebetween. As a result, a position of the right lower stay 61 with respect to the rear side plate 52 in the vertical direction (arrow Z direction) is determined with a backlash corresponding to a predetermined interval.

Next, an assembly configuration of the right lower stay 61 and the right support column 58 will be described. As illustrated in FIGS. 21A, 21B, 23A, and 23B, an insertion hole 58*a* into which a step-bent portion 61*b* of the right lower stay 61 is inserted is formed in the flat surface portion 58*w*2 of the right support column 58. In addition, the right support column 58 has a flat surface portion 58*w*3 extending in the arrow Y direction from the periphery of the insertion hole 58*a* in the flat surface portion 58*w*2 rearward of the image forming apparatus A. The flat surface portion 58*w*3 is provided with a projection portion 58*b* protruding in a plate thickness direction (arrow X direction) of the flat surface portion 58*w*3 and having a substantially semicircular shape. The projection portion 58*b* is formed by drawing, and is arranged at a position adjacent to the insertion hole 58*a* in an insertion direction (arrow Y direction) of the step-bent portion 61*b* into the insertion hole 58*a*.

In addition, the flat surface portion 61*w*1 of the right lower stay 61 is provided with the step-bent portion 61*b* inserted into and engaged with the insertion hole 58*a* of the right support column 58. The step-bent portion 61*b* has a portion bent in the plate thickness direction (arrow X direction) of the flat surface portion plate 61*w*1 and a portion bent and extended from that portion in an insertion direction (arrow Y direction) into the right support column 58.

In addition, a through-hole 61*c* penetrating the flat surface portion 61*w*1 in the plate thickness direction of the flat surface portion 61*w*1 is formed around the step-bent portion 61*b* in the flat surface portion 61*w*1 of the right lower stay 61. The through-hole 61*c* is arranged at a position adjacent to the step-bent portion 61*b* in the insertion direction of the right lower stay 61 into the right support column 58. As described above, the right lower stay 61 is formed of one sheet metal, and the through-hole 61*c* is a hole formed when the step-bent portion 61*b* is formed.

When the right lower stay 61 is assembled, the step-bent portion 61*b* of the right lower stay 61 is inserted into and engaged with the insertion hole 58*a* of the right support column 58, and the projection portion 58*b* of the right support column 58 engages with the through-hole 61*c* of the right lower stay 61. As described above, the step-bent portion 61*b* engages with the insertion hole 58*a*, such that a position of the right lower stay 61 with respect to the right support column 58 in the arrow X direction and the arrow Y direction is determined. In addition, an upper surface of the step-bent portion 61*b* and an inner wall of an upper side of the insertion hole 58*a* face each other with a predetermined interval therebetween, and a lower surface of the step-bent portion 61*b* and an inner wall of a lower side of the insertion hole 58*a* face each other with a predetermined interval therebetween. As a result, a position of the right lower stay 61 with respect to the right support column 58 in the vertical direction (arrow Z direction) is determined with a backlash corresponding to a predetermined interval.

Note that in a process of inserting the step-bent portion 61*b* into the insertion hole 58*a*, the right lower stay 61 rides up by a height of a tip portion of the projection portion 58*b*. At this time, although a force is temporarily applied to the step-bent portion 61*b* in a direction in which the step-bent portion 61*b* opens, the height of the tip portion of the projection portion 58*b* is set to a height within a range in which the step-bent portion 61*b* is deformed in an elastic region.

In addition, in a state where the right lower stay 61 engages with the rear side plate 52 or the right support column 58, the projection portion 58*b* abuts on an inner wall 61*d* of the through-hole 61*c*, such that movement of the right lower stay 61 with respect to the rear side plate 52 and the right support column 58 in a direction opposite to the insertion direction is restricted. That is, in order to detach the right lower stay 61 from the rear side plate 52 and the right support column 58, it is necessary to apply a force in both of the plate thickness direction of the flat surface portion 61*w*1 of the right lower stay 61 and a direction opposite to the insertion direction of the right lower stay 61 into the rear side plate 52 and the right support column 58 to the right lower stay 61.

Here, a length (distance) of each part in the insertion direction (arrow Y direction) of the right lower stay 61 into the rear side plate 52 and the right support column 58 is defined as follows. That is, an engagement length of the step-bent portion 61*a* with the bent portion 250 illustrated in FIG. 22B is L5, and an engagement length of the step-bent portion 61*b* with the insertion hole 58*a* in the insertion direction illustrated in FIG. 23B is L6. In addition, a distance between the tip portion of the projection portion 58*b* and the inner wall 61*d* of the through-hole 61*c* illustrated in FIG. 23B when the step-bent portion 61*a* engages with the bent portion 250 and the step-bent portion 61*b* engages with the insertion hole 58*a* is L7.

At this time, a relationship among L5, L6, and L7 is L5>L6>L7. As a result, even in a case where the right lower stay 61 has moved in the direction opposite to the insertion direction into the rear side plate 52 and the right support column 58, at a point in time when the projection portion 58*b* abuts on the inner wall 61*d* of the through-hole 61*c* to restrict the movement of the right lower stay 61, an engaging state between the step-bent portion 61*a* and the bent portion 250 and an engaging state between the step-bent portion 61*b* and the insertion hole 58*a* are maintained. Therefore, it is possible to prevent the right lower stay 61 from being separated from the rear side plate 52 or the right support column 58 to prevent position accuracy between the right lower stay 61, and the rear side plate 52 and the right support column 58 from being deteriorated.

In addition, by satisfying a relationship of L5>L6, engagement between the step-bent portion 61*a* and the bent portion 250 between which an engagement length is relatively long is performed first and engagement between the step-bent portion 61*b* and the insertion hole 58*a* between which an engagement length is relatively short is performed later, when the right lower stay 61 is assembled. By providing a difference between the engagement lengths as described above, the order of assembling the right lower stay 61 can be determined, such that workability at the time of assembling the right lower stay 61 can be improved.

Note that an engagement length of the right lower stay 61 with the through-hole 251 of the rear side plate 52 in the insertion direction at one end portion of the right lower stay 61 in the arrow Y direction is L8. In this case, a maximum engagement length of the right lower stay 61 with the rear side plate 52 in the insertion direction is L8. That is, a relationship of L5 to L8 is a relationship of L8>L5>L6>L7.

Figure 24:
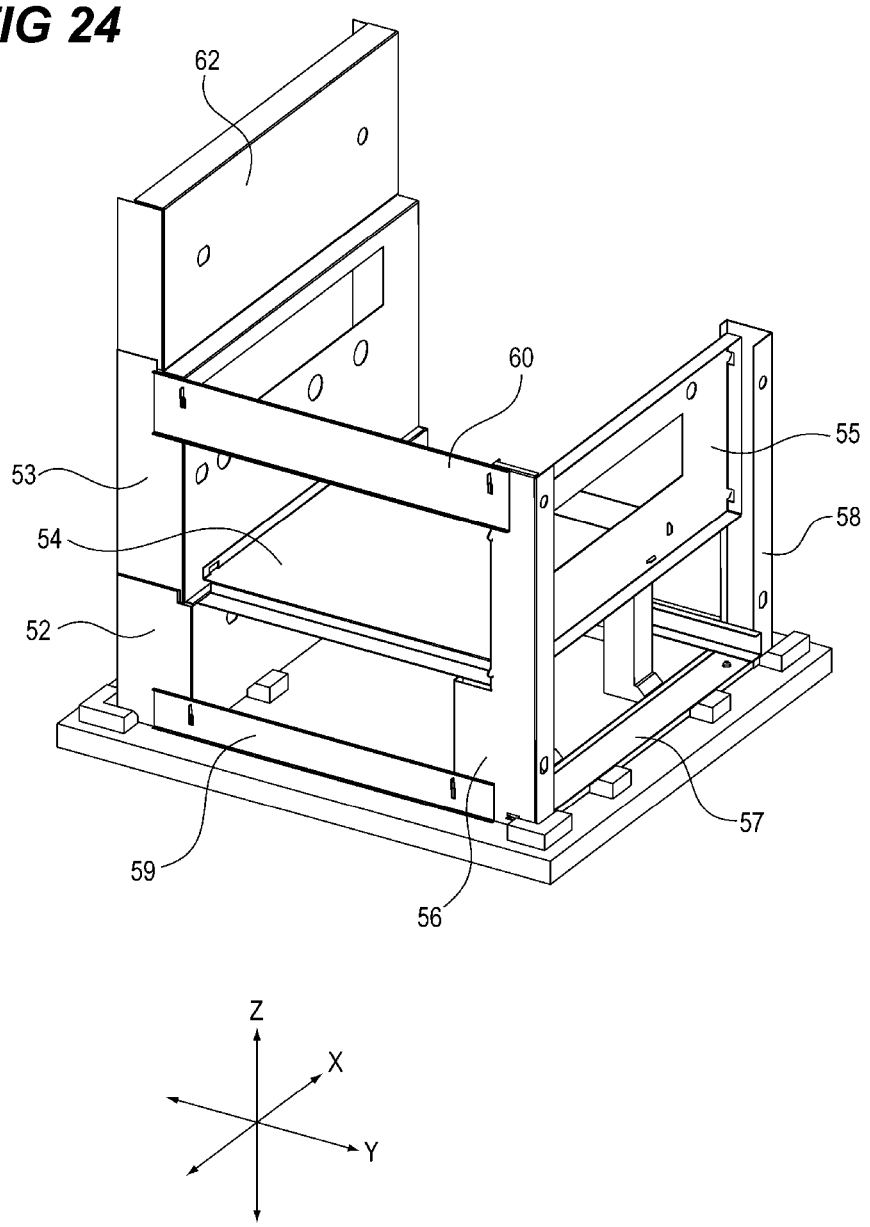
FIG. 24 is a perspective view when a rear side plate is assembled.

Next, as illustrated in FIG. 24, the rear side plate 62 is assembled. The rear side plate 62 is inserted and assembled into the rear side plate 53 from the arrow Z direction. An assembly configuration of the rear side plate 62 and the rear side plate 53 is similar to that of the rear side plate 52 and the rear side plate 53, and is an assembly configuration in which the rear side plate 62 and the rear side plate 53 are inserted into and engaged with each other.

Figure 25A:
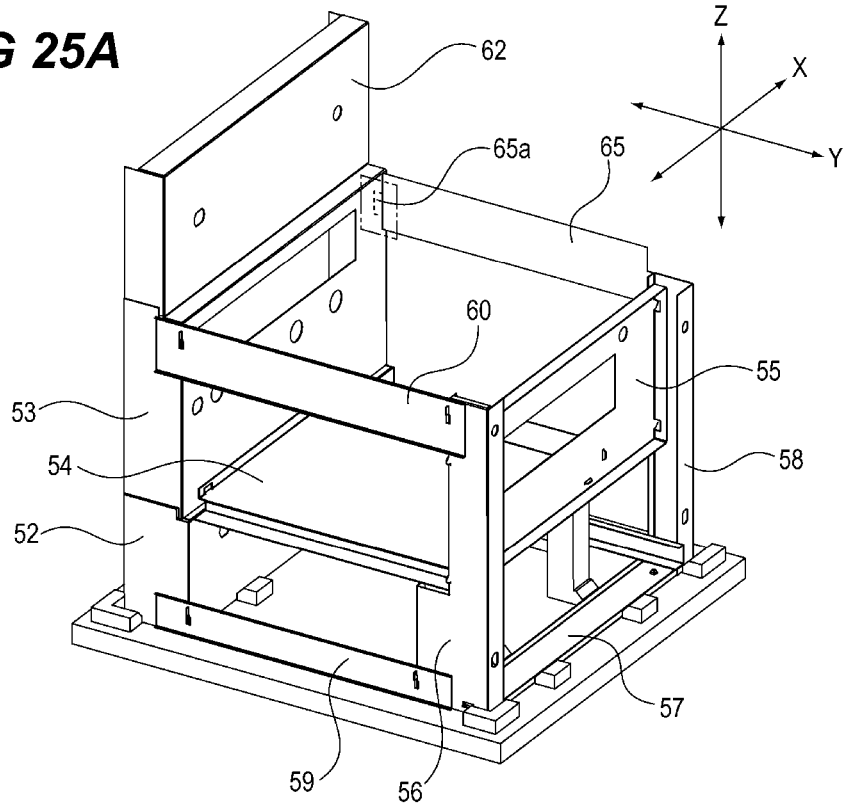
FIGS. 25A and 25B are perspective views when a right middle stay is assembled.
Figure 25B:
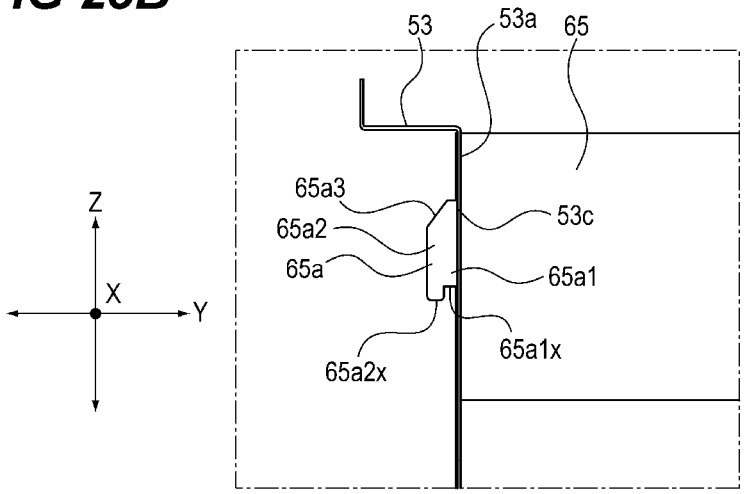

Next, as illustrated in FIGS. 25A and 25B, the right middle stay 65 is assembled. The right middle stay 65 is a plate-shaped member formed by one flat surface. The right middle stay 65 is inserted and assembled into the rear side plate 53 and the right support column 58. An assembly configuration of the right middle stay 65 and the rear side plate 53 and an assembly configuration of the right middle stay 65 and the right support column 58 are similar to each other. Therefore, only the assembly configuration of the right middle stay 65 and the rear side plate 53 will be mainly described here.

A through-hole 53*c* penetrating the support portion 53*a* in the plate thickness direction (arrow Y direction) of the support portion 53*a* is formed in the support portion 53*a* of the rear side plate 53. Note that the rear side plate 53 is a member extending in the vertical direction. In addition, the right middle stay 65 is provided with a protrusion portion 65*a* protruding in an insertion direction (arrow Y direction) into the support portion 53*a* of the rear side plate 53 and inserted into the through-hole 53*c* of the rear side plate 53 from the arrow Y direction.

The protrusion portion 65*a* has a base portion 65*a*1 fitted into the through-hole 53*c* and a hook portion 65*a*2 provided in front of the base portion 65*a*1 in the insertion direction and having a lower end portion 65*a*2*x* located below a lower end portion 65*a*1*x* of the base portion 65*a*1 in the vertical direction. In addition, the protrusion portion 65*a* has an inclined portion 65*a*3 inclined so that a height decreases from an upper end portion of the base portion 65*a*1 to an upper end portion of the hook portion 65*a*2.

When the protrusion portion 65*a* is inserted into the through-hole 53*c*, the hook portion 65*a*2, which is a tip portion of the protrusion portion 65*a*, is first inserted, the base portion 65*a*1 is inserted, and the base portion 65*a*1 is then fitted into the through-hole 53*c*. A width of the base portion 65*a*1 of the protrusion portion 65*a* in the vertical direction and a width of the through-hole 53*c* in the vertical direction are substantially the same as each other. In addition, a plate thickness of the right middle stay 65 and a width of the through-hole 53*c* in the arrow X direction are substantially the same as each other. Therefore, the base portion 65*a*1 of the protrusion portion 65*a* is fitted into the through-hole 53*c*, such that a position of the right middle stay 65 with respect to the rear side plate 53 in the vertical direction (arrow Z direction) and a position of the right middle stay 65 with respect to the rear side plate in a direction (arrow X direction) orthogonal to the insertion direction and the vertical direction are determined.

In addition, in a state where the base portion 65*a*1 of the protrusion portion 65*a* is fitted into the through-hole 53*c*, the lower end portion 65*a*2*x* of the hook portion 65*a*2 is located at a position facing a portion below the through-hole 53*c* in the support portion 53*a* of the rear side plate 53. As a result, the hook portion 65*a*2 is hooked on the support portion 53*a*, such that movement of the right middle stay 65 with respect to the support portion 53*a* of the rear side plate 53 in a direction opposite to the insertion direction is restricted. Therefore, the right middle stay 65 can be assembled to the rear side plate 53 with high position accuracy without being separated from the rear side plate 53.

Figure 26:
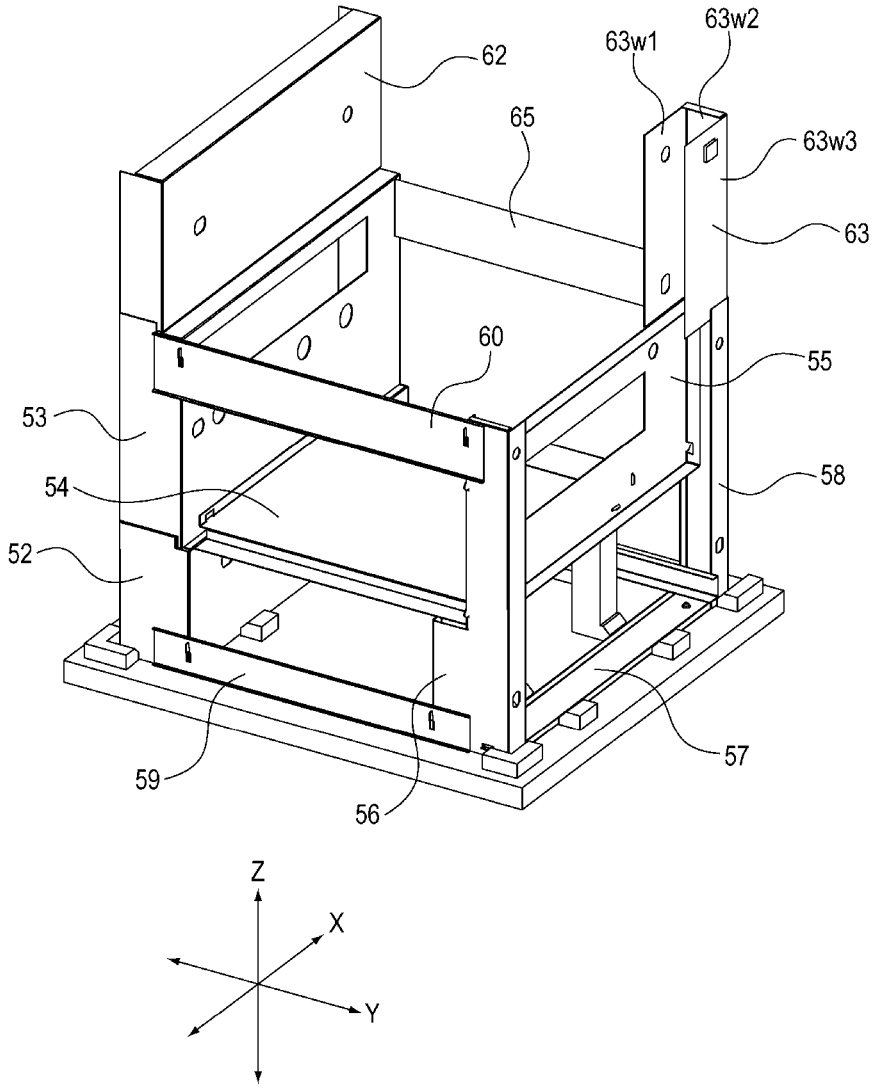
FIG. 26 is a perspective view when a right support column is assembled.

Next, as illustrated in FIG. 26, the right support column 63 is assembled. The right support column 63 has a flat surface portion 63*w*1 extending in parallel with the flat surface portion 55*w*1 of the front side plate 55, a flat surface portion 63*w*2 bent substantially vertically from the flat surface portion 63*w*1 in the arrow Y direction, and a flat surface portion 63*w*3 bent substantially vertically from the flat surface portion 63*w*2 so as to face the flat surface portion 63*w*1. The right support column 63 and the right support column 58 are inserted and assembled into each other.

Figure 27A:
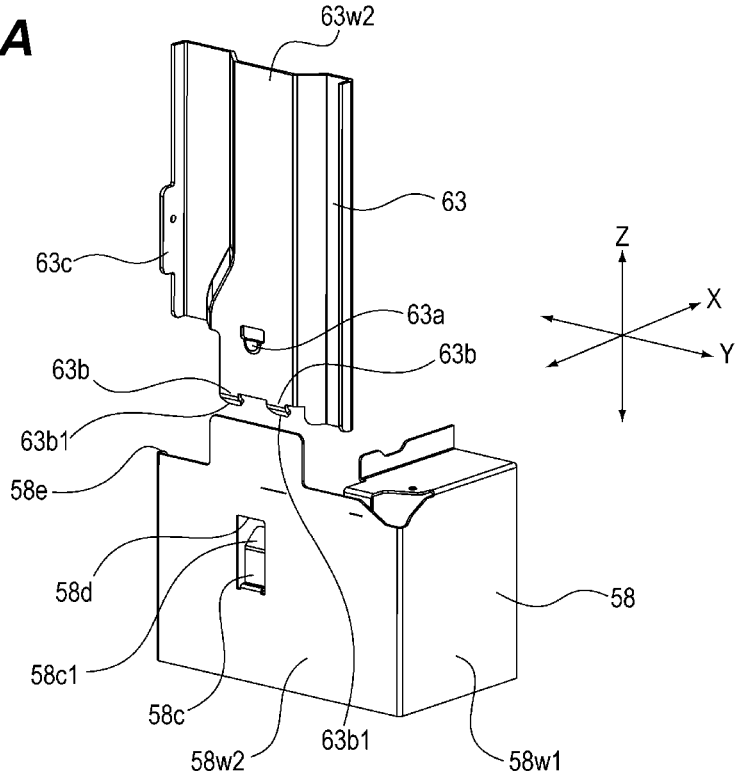
FIGS. 27A and 27B are enlarged perspective views of an engaging portion between the right support column and the right support column.
Figure 27B:
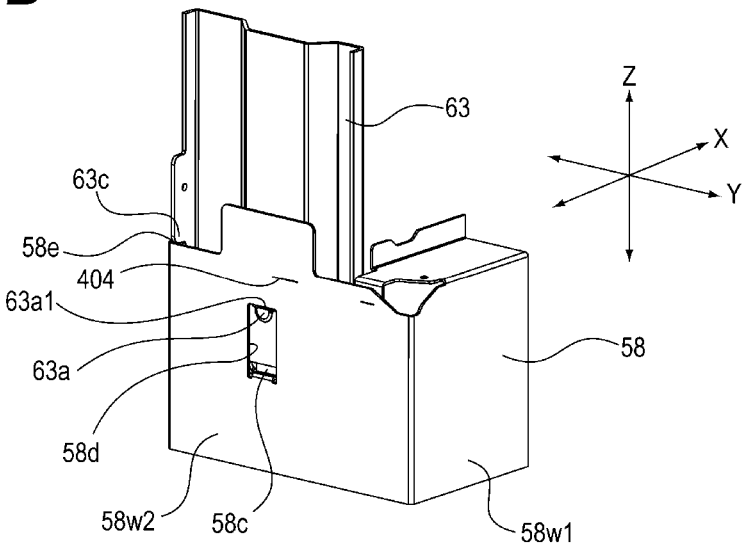
Figure 28A:
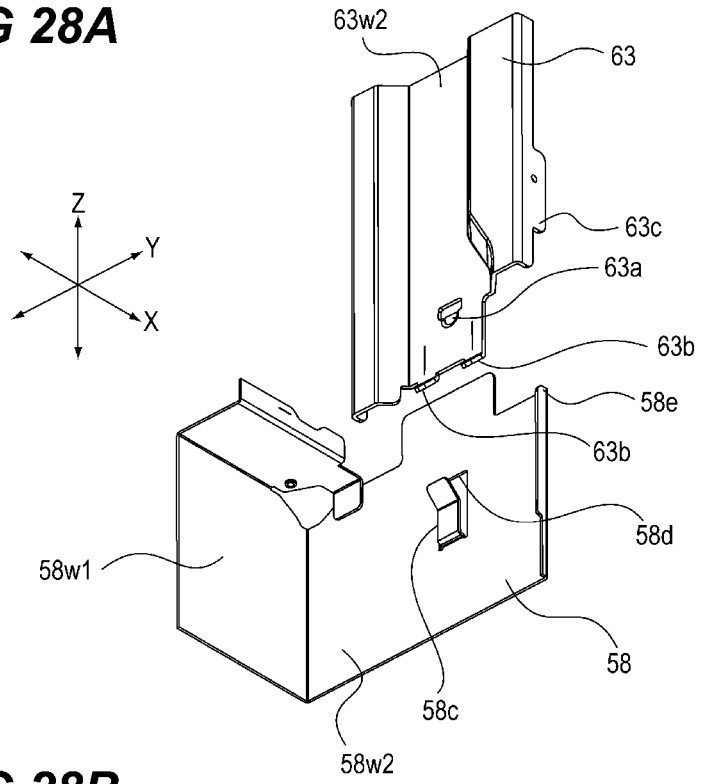
FIGS. 28A and 28B are enlarged perspective views of the engaging portion between the right support column and the right support column.
Figure 28B:
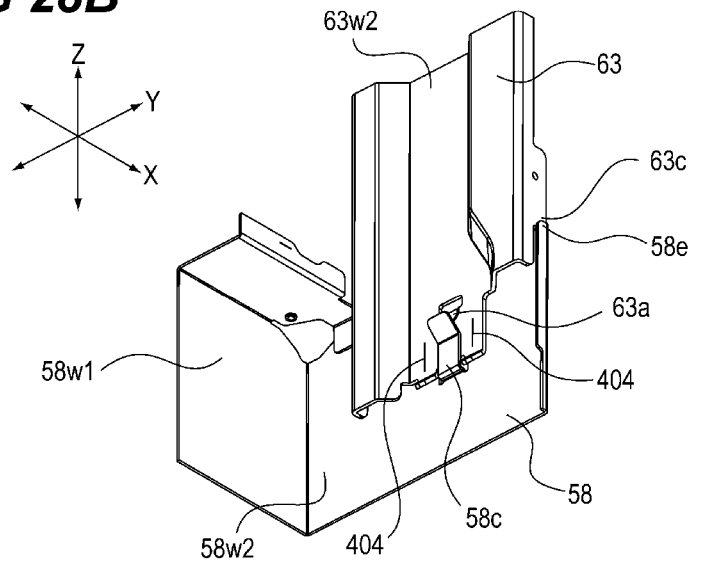

FIGS. 27A to 28B are enlarged perspective views of an engaging portion between the right support column 63 and the right support column 58. Here, FIGS. 27A and 28A illustrate a state before the right support column 63 and the right support column 58 are assembled to each other, and FIGS. 27B and 28B illustrate a state where the right support column 63 and the right support column 58 are assembled to each other. In addition, FIGS. 27A and 27B are views of the right support column 63 and the right support column 58 when viewed from the inside of the image forming apparatus A, and FIGS. 28A and 28B are views of the right support column 63 and the right support column 58 when viewed from the outside of the image forming apparatus A.

As illustrated in FIGS. 27A to 28B, the flat portion 63*w*2 of the right support column 63 (second support) is provided with a projection portion 63*a* (protruded portion) protruding in a plate thickness direction (arrow X direction) of the flat surface portion 63*w*2 and two protrusion portions 63*b* protruding in an insertion direction (arrow Z direction) into the right support column 58. Here, the protrusion portions 63*b* are provided below the projection portion 63*a* in the vertical direction. The projection portion 63*a* (second engaging portion) is formed by drawing, and a protrusion amount of the projection portion 63*a* from a surface of the flat surface portion 63*w*2 is about 0.3 mm to 2 mm. In addition, tip portions of the protrusion portions 63*b* (first and second protrusion portions) are inclined portions 63*b*1 (first and second inclined portions) inclined in a direction away from the flat surface portion 63*w*2 with respect to the insertion direction of the right support column 63 into the right support column 58.

The flat surface portion 58*w*2 of the right support column 58 (first support) is provided with a step-bent portion 58*c* (first engaging portion) protruding in an insertion direction (arrow Z direction) of the right support column 58 into the right support column 63. In addition, a through-hole 58*d* penetrating the flat surface portion 58*w*2 in a plate thickness direction (arrow X direction) of the flat surface portion 58*w*2 is formed at a position adjacent to the step-bent portion 58*c* in the insertion direction of the right support column 58 with respect to the right support column 63. As described above, the right support column 58 is formed of one sheet metal, and the through-hole 58*d* is a hole formed when the step-bent portion 58*c* is processed.

The step-bent portion 58*c* has a portion (first bent portion) bent in the plate thickness direction of the flat surface portion plate 58*w*2 and a portion (second bent portion) bent and extended from that portion in the insertion direction into the right support column 63. In addition, a tip portion of the step-bent portion 58*c* is an inclined portion 58*c*1 inclined in a direction away from the flat surface portion 58*w*2 with respect to the insertion direction of the right support column 58 into the right support column 63.

When the right support column 63 is assembled to the right support column 58, the inclined portion 58*c*1 of the step-bent portion 58*c* of the right support column 58 abuts on the flat surface portion 63*w*2 of the right support column 63, and the inclined portion 63*b*1 of the protrusion portion 63*b* of the right support column 63 abuts on the flat surface portion 58*w*2 of the right support column 58. As a result, movement of the right support column 63 and the right support column 58 in the arrow Z direction is guided, and the flat surface portion 63*w*2 and the flat surface portion 58*w*2 move in a predetermined positional relationship. In addition, a lower end portion of a stopper portion 63*c* of the right support column 63 butts a butting portion 58*e*, which is an upper end portion of the flat surface portion 58*w*2 of the right support column 58, such that movement of the right support column 63 with respect to the right support column 58 in the insertion direction (arrow Z direction) is restricted.

When the right support column 63 is assembled to the right support column 58, the step-bent portion 58*c* of the right support column 58 is inserted into the flat surface portion 63*w*2 of the right support column 63, and engages with a lower end portion of the flat surface portion 63*w*2 so as to be hooked on a lower end portion of the flat surface portion 63*w*2. As a result, the flat surface portion 63*w*2 of the right support column 63 is sandwiched from the plate thickness direction (arrow X direction) of the flat surface portion 63*w*2 by the step-bent portion 58*c* and the flat surface portion 58*w*2 in the right support column 58, such that a position of the right support column 63 with respect to the right support column 58 in the arrow X direction is determined.

In addition, the projection portion 63*a* of the right support column 63 engages with the through-hole 58*d* formed in the right support column 58. As a result, an edge portion 63*a*1 of the projection portion 63*a* abuts on an inner wall of the through-hole 58*d*, such that movement of the right support column 63 with respect to the right support column 58 in a direction opposite to the insertion direction is restricted. Here, the through-hole 58*d* is arranged at a position adjacent to the step-bent portion 58*c* in the insertion direction of the right support column 58 into the right support column 63. Therefore, the projection portion 63*a* engaged with the through-hole 58*d* and the step-bent portion 58*c* are arranged at positions adjacent to each other in the insertion direction.

A configuration in which the edge portion 63*a*1 of the projection portion 63*a* abuts on the inner wall of the through-hole 58*d* formed when the step-bent portion 58*c* is processed has been described in the present embodiment, but a configuration in which the edge portion 63*a*1 of the projection portion 63*a* abuts on an inner wall of another through-hole different from the through-hole 58*d* may be adopted. As a result, the movement of the right support column 63 with respect to the right support column 58 in the direction opposite to the insertion direction is restricted.

In addition, in a direction (arrow Y direction) orthogonal to the plate thickness direction of the flat surface portion 63*w*2 and the insertion direction into the right support column 58, the two protrusion portions 63*b* of the right support column 63 engage with the step-bent portion 58*c* so as to sandwich the step-bent portion 58*c* of the right support column 58 therebetween. As a result, a position of the right support column 63 with respect to the right support column 58 in the orthogonal direction is determined.

As described above, the projection portion 63*a* restricting the movement of the right support column 63 with respect to the right support column 58 in the direction opposite to the insertion direction is provided in the vicinity of the step-bent portion 58*c* engaging the flat surface portion 63*w*2 of the right support column 63 and the flat surface portion 58*w*2 of the right support column 58 with each other. As a result, it is possible to prevent the right support column 63 from moving with respect to the right support column 58 in the direction opposite to the insertion direction, such that the right support column 63 and the right support column 58 are separated from each other, resulting in deterioration of position accuracy. Therefore, the right support column 63 and the right support column 58 that constitute the frame 31 can be assembled to each other with high position accuracy.

Here, an assembly configuration of the right support column 63 and the right support column 58 has been described, but a similar configuration may be used at the time of assembling other sheet metals to each other. For example, an assembly shape of the rear side plate 52 and the rear side plate 53 may be the shape described above.

Note that the right support column 58 and the right support column 63 are joined to each other at a joining position 404 in FIGS. 27A to 28B. Details of the joining position 404 will be described later.

Figure 29A:
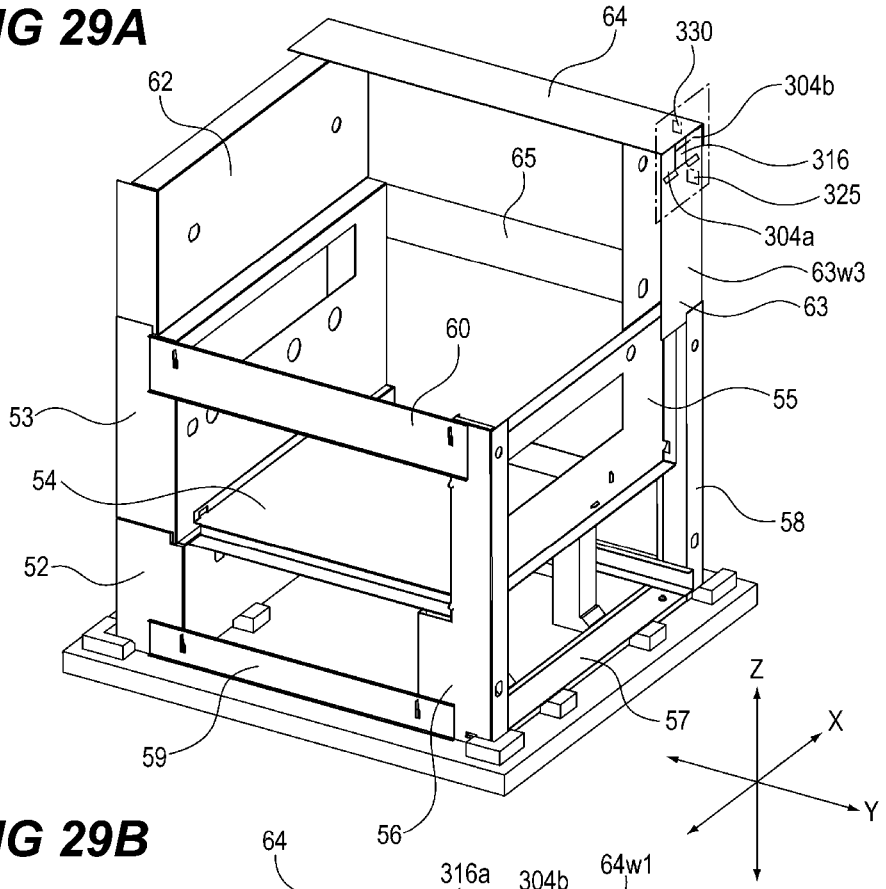
FIGS. 29A and 29B are perspective views when a right upper stay is assembled.
Figure 29B:
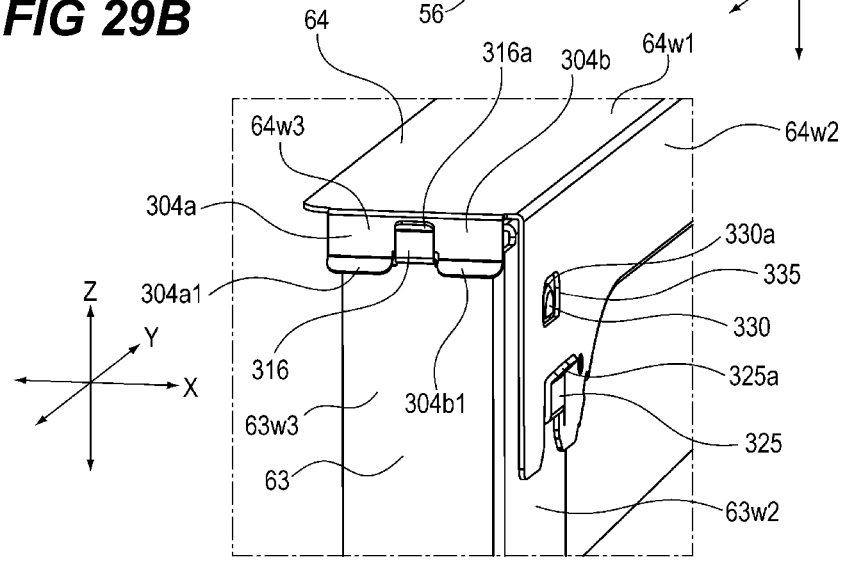

Next, as illustrated in FIGS. 29A and 29B, the right upper stay 64 is assembled. The right upper stay 64 has a flat surface portion 64*w*1 extending in the horizontal direction, a flat surface portion 64*w*2 formed by bending one end portion of the flat surface portion 64*w*1 in the arrow X direction substantially vertically in the vertical direction, and a flat surface portion 64*w*3 formed by bending one end portion of the flat surface portion 64*w*1 in the arrow Y direction substantially vertically in the vertical direction. In addition, the right upper stay 64 has a flat surface portion (not illustrated) formed by bending the other end portion of the flat surface portion 64*w*1 in the arrow Y direction substantially vertically in the vertical direction. The right upper stay 64, and the rear side plate 62 and the right support column 63 are inserted and assembled into with each other. An assembly configuration of the right upper stay 64 and the rear side plate 62 and an assembly configuration of the right upper stay 64 and the right support column 63 are similar to each other. Therefore, only the assembly configuration of the right upper stay 64 and the right support column 63 will be described here.

The flat surface portion 64*w*3 of the right upper stay 64 includes three bent portions 304*a*, 304*b*, and 304*c* bent from the flat surface portion 64*w*1 in an insertion direction (arrow Z direction) into the right support column 63. That is, when the flat surface portion 64*w*3 is divided into three portions in the arrow X direction, there are bent portions 304*a*, 304*b*, and 304*c*. The bent portion 304*c* is arranged at a position between the bent portion 304*a* and the bent portion 304*b* in the arrow X direction, and a length of the bent portion 304*c* in the arrow Z direction is smaller than that of the bent portions 304*a* and 304*b* in the arrow Z direction. In addition, the bent portions 304*a* and 304*b* have the same length in the arrow Z direction, and tip portions of the bent portions 304*a* and 304*b* are inclined portions 304*a*1 and 304*b*1 inclined in a direction away from the flat surface portion 64*w*1 with respect to the insertion direction into the right support column 63.

In addition, the flat surface portion 63*w*3 of the right support column 63 is provided with a step-bent portion 316 protruding in an insertion direction into the right upper stay 64 and inserted into and engaged with the right upper stay 64 so as to overlap with the bent portion 304*c* of the right upper stay 64 in a plate thickness direction (arrow Y direction) of the flat surface portion 63*w*3. In addition, the flat surface portion 63*w*2 of the right support column 63 is provided with a step-bent portion 325 protruding in the insertion direction into the right upper stay 64 and inserted into and engaged with the flat surface portion 64*w*2 so as to overlap with the flat surface portion 64*w*2 of the right upper stay 64 in a plate thickness direction (arrow X direction) of the flat surface portion 63*w*2. In addition, the flat surface portion 63*w*2 of the right support column 63 is provided with a projection portion 330 protruding in the plate thickness direction (arrow X direction) of the flat surface portion 63*w*2.

The step-bent portion 316 has a portion bent in the plate thickness direction (arrow Y direction) of the flat surface portion 63*w*3 of the right support column 63 and a portion bent and extended from that portion in the insertion direction (arrow Z direction) into the right upper stay 64. In addition, a tip portion of the step-bent portion 316 is an inclined portion 316*a* formed by further bending a portion of the step-bent portion 316 bent in the insertion direction into the right upper stay 64 and inclined in a direction away from the flat surface portion 63*w*3 with respect to the insertion direction into the right upper stay 64.

The step-bent portion 325 has a portion bent in the plate thickness direction (arrow X direction) of the flat surface portion 63*w*2 of the right support column 63 and a portion bent and extended from that portion in the insertion direction (arrow Z direction) into the right upper stay 64. In addition, a tip portion of the step-bent portion 325 is an inclined portion 325*a* formed by further bending a portion of the step-bent portion 325 bent in the insertion direction into the right upper stay 64 and inclined in a direction away from the flat surface portion 63*w*2 with respect to the insertion direction into the right upper stay 64.

When the right upper stay 64 is assembled to the right support column 63, the inclined portions 316*a* and 325*a* of the step-bent portions 316 and 325 of the right support column 63 abut on the right upper stay 64, and the inclined portion 304*a*1 and 304*b*1 of the bent portions 304*a* and 304*b* of the right upper stay 64 abut on the right support column 63. As a result, movement of the right upper stay 64 and the right support column 63 is guided, such that the right upper stay 64 and the right support column 63 move in a predetermined positional relationship.

When the step-bent portion 316 engages with the bent portion 304*c* of the right upper stay 64 and the bent portions 304*a* and 304*b* engage with the flat surface portion 63*w*3 of the right support column 63, the step-bent portion 316 and the bent portions 304*a* and 304*b* alternately perform engagement in a direction (arrow X direction) orthogonal to the insertion direction of the right support column 63 into the right upper stay 64 and the plate thickness direction. Specifically, the bent portion 304*a* engages with the flat surface portion 63*w*3 of the right support column 63 at a position adjacent to the step-bent portion 316 in the arrow X direction. In addition, the bent portion 304*b* engages with the flat surface portion 63*w*3 of the right support column 63 on a side opposite to a side where the bent portion 304*a* is arranged, with respect to the step-bent portion 316, and at a position adjacent to the step-bent portion 316, in the arrow X direction. With such a configuration, the right upper stay 64 and the right support column 63 are firmly engaged with and assembled to each other.

In addition, the projection portion 330 of the right support column 63 engages with a through-hole 335 formed in the flat surface portion 64*w*2 of the right upper stay 64 and penetrating the flat surface portion 64*w*2 in a plate thickness direction (arrow X direction) of the flat surface portion 64*w*2. As a result, an edge portion 330*a* of the projection portion 330 abuts on an inner wall of the through-hole 335, such that movement of the right upper stay 64 with respect to the right support column 63 in a direction opposite to the insertion direction is restricted.

As described above, the respective sheet metals constituting the frame 31 are assembled. The frame 31 assembled in the assembling process as described above is configured to be able to stand for oneself. Therefore, the frame 31 can be detached from the stand 33 by grasping the rear side plate 52, the left support column 56, the right support column 58, and the like, of the frame 31 and lifting the frame 31.

<Joining Process of Frame>

Next, a process of joining the frame 31 assembled in the assembling process described above will be described.

Figure 30:
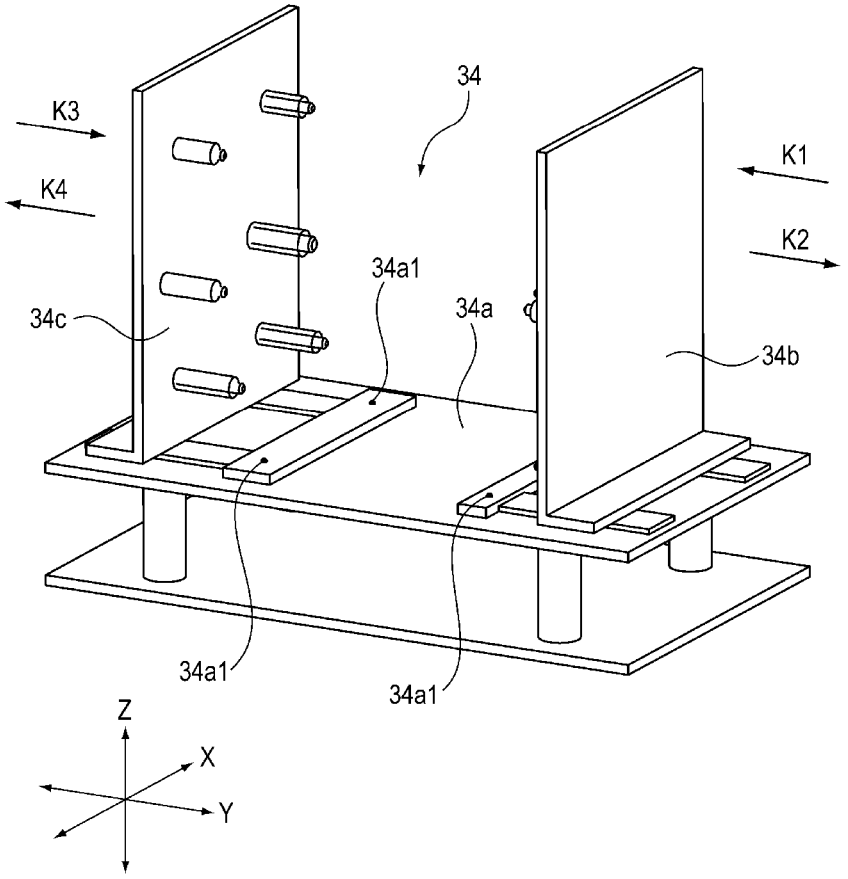
FIG. 30 is a perspective view of a jig used for joining of the frame.

FIG. 30 is a perspective view of a jig 34 used for joining of the frame 31. As illustrated in FIG. 30, the jig 34 has a base 34*a*, a front side support portion 34*b*, and a rear side support portion 34*c*. The base 34*a* is provided with positioning pins 34*a*1. In addition, the front side support portion 34*b* and the rear side support portion 34*c* are configured to be slidable with respect to the base 34*a*. The front side support portion 34*b* is slidable in an arrow K1 direction and an arrow K2 direction, and the rear side support portion 34*c* is slidable in an arrow K3 direction and an arrow K4 direction.

Figure 31:
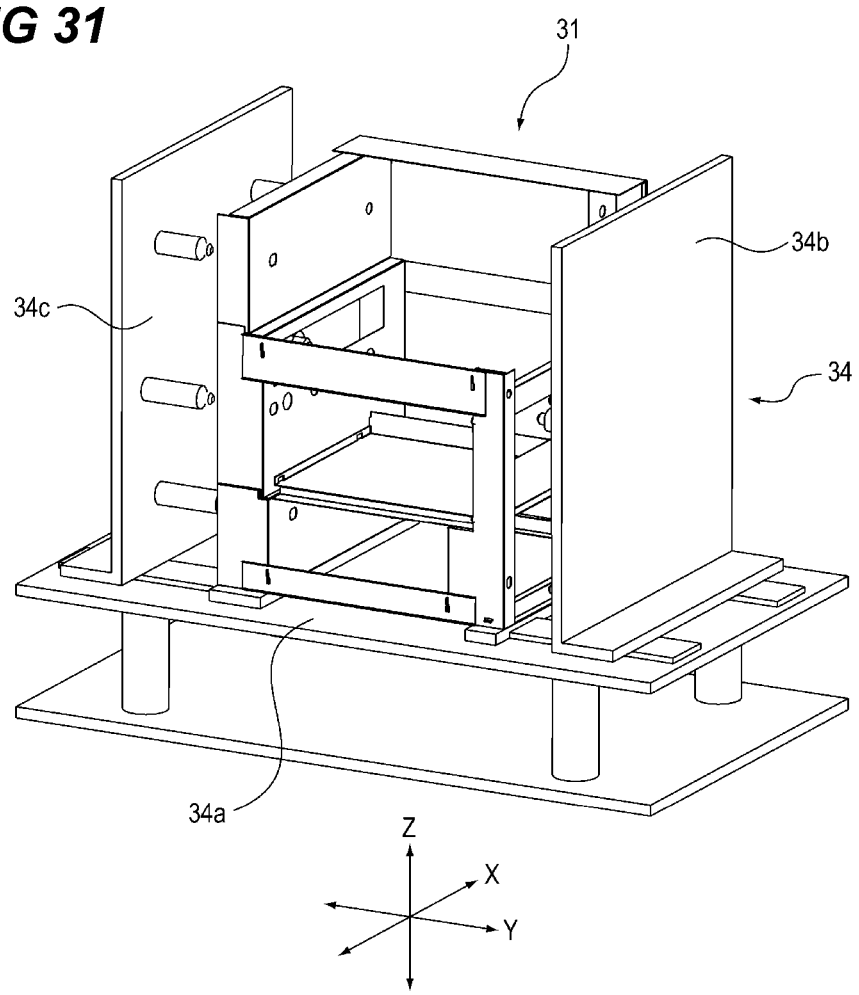
FIG. 31 is a perspective view of the frame and the jig.

FIG. 31 is a perspective view of the frame 31 assembled in the assembling process described above and the jig 34. As illustrated in FIG. 31, the frame 31 is detached from the stand 33 and placed on the base 34*a* of the jig 34 after the assembling process. At this time, the positioning pins 34*a*1 of the base 34*a* are inserted into the positioning holes 51*a* of the rear bottom plate 51 of the frame 31 or the positioning holes 57*b* of the front lower stay 57, such that a position of the frame 31 with respect to the base 34*a* is determined.

Figure 32:
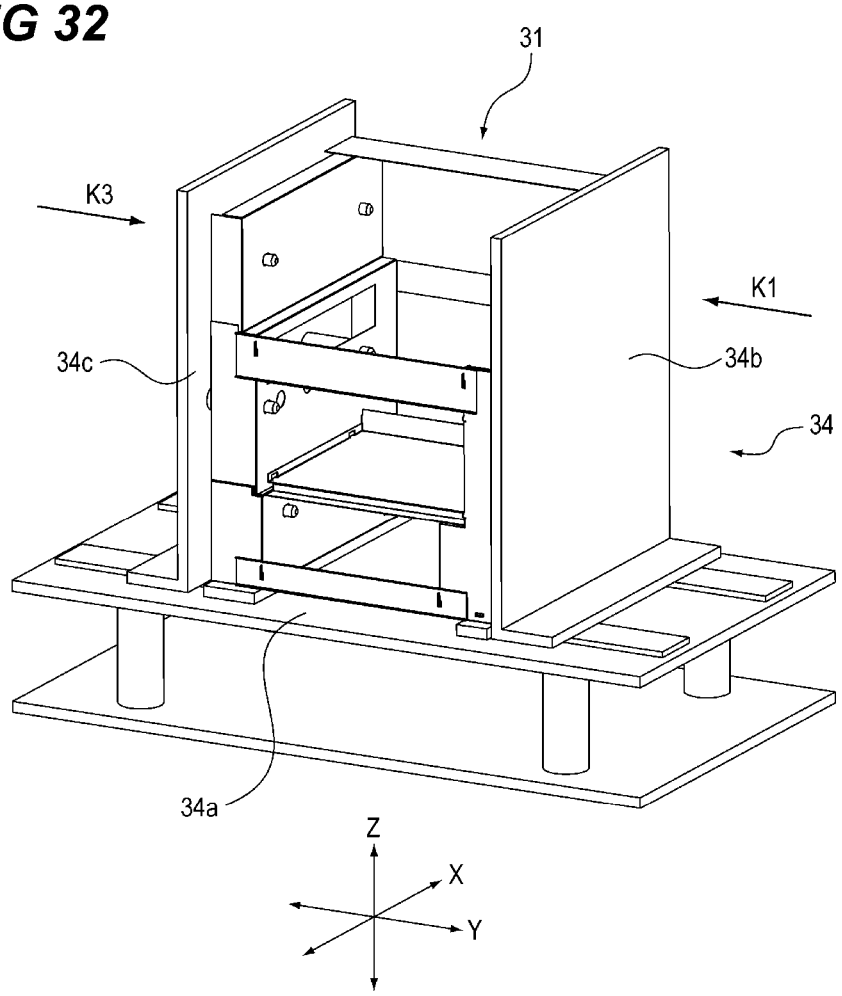
FIG. 32 is a perspective view of the frame and the jig.

As illustrated in FIG. 32, when joining the frame 31, an operator who performs a joining process slides the front side support portion 34*b* in the arrow K1 direction and slides the rear side support portion 34*c* in the arrow K3 direction. In addition, the frame 31 is pressed from a direction orthogonal to slide directions of the front side support portion 34*b* and the rear side support portion 34*c* and the vertical direction by a pressing device (not illustrated). As a result, the sheet metals constituting the frame 31 are pressed against each other, such that unnecessary gaps between the sheet metals are eliminated, and positioning is completed.

Then, the respective sheet metals constituting the frame 31 are joined to each other by fiber laser welding by the operator.

Here, when the welding is performed, if an interval between welded portions of the two sheet metals to be welded is too wide, a molten metal volume becomes insufficient, such that a joining force after the welding becomes weak. For example, in a case where one of the two sheet metals falls in the plate thickness direction, such that a posture changes, an interval between the two sheet metals in the plate thickness direction may become wide. In the following, a configuration for preventing such a decrease in the joining force will be described by taking welding between the right support column 58 and the right support column 63 as an example.

As illustrated in FIGS. 27A to 28B, in the right support column 58 and the right support column 63, the flat surface portion 63*w*2 of the right support column 63 is sandwiched from the plate thickness direction (arrow X direction) of the flat surface portion 63*w*2 by the step-bent portion 58*c* and the flat surface portion 58*w*2 in the right support column 58, such that a position of the right support column 63 with respect to the right support column 58 in the arrow X direction is determined. As a result, it is restricted that the right support column 63 falls in the plate thickness direction of the flat surface portion 63*w*2 (arrow X direction), such that a posture of the right support column 63 changes. That is, it becomes easy to guarantee a dimension of an interval between the right support column 63 and the right support column 58 in the arrow X direction in the vicinity of the step-bent portion 58*c*.

Therefore, in the present embodiment, three welded portions 404 have been provided at a position within a radius of 50 mm from a position where the step-bent portion 58*c* abuts on the flat surface portion 63*w*2 of the right support column 63 and adjacent to the step-bent portion 58*c*, in the vicinity of the step-bent portion 58*c* of the right support column 58. Here, the right support column 58 and the right support column 63 are formed using an electrogalvanized steel sheet having a plate thickness of 0.5 mm to 2.0 mm. In this case, in order to guarantee the joining force after welding, an interval between welded portions in the plate thickness direction needs to be 0.3 mm or less. In a region within the radius of 50 mm from the position where the step-bent portion 58*c* abuts on the flat surface portion 63*w*2 of the right support column 63 as described above, it is guaranteed that the interval between the flat surface portion 58*w*2 of the right support column 58 and the flat surface portion 63*w*2 of the right support column 63 in the plate thickness direction is 0.3 mm or less. As a result, it is possible to prevent the decrease in the joining force after the welding due to the insufficiency of the molten metal volume.

Note that the welding portions 404 have been provided in the region within the radius of 50 mm from the position where the step-bent portion 58*c* abuts on the flat surface portion 63*w*2 of the right support column 63 in the present embodiment, but in a case where the step-bent portion 58*c* has a sufficient size, the step-bent portion 58*c* and the flat surface portion 63*w*2 may be directly welded to each other.

Note that the welding is performed at the three welded portions 404 described above in the present embodiment, but the above effect can be obtained by performing the welding at at least any one of positions in the vicinity of the step-bent portion 58*c*. That is, the welding positions may be appropriately changed according to a strength required for the frame 31. However, a configuration in which the welding is performed at a plurality of positions in the vicinity of the step-bent portion 58*c* as in the present embodiment can be useful. The reason is that when a force is applied to the frame 31, a stress is dispersed, such that a risk of breakage is easily reduced. In addition, by making welding lengths of the welded portions 404 the same as each other, a strength after the welding becomes uniform, such that a risk of breakage due to stress concentration can be reduced.

Note that the configuration in which the sheet metals constituting the frame 31 are joined to each other by the welding has been described in the present embodiment, but the present invention is not limited thereto, and the sheet metals may be joined to each other by screws. In this case, by performing screwing using an automatic machine in the region in which the interval between the two sheet metals in the plate thickness direction is guaranteed as described above, it is possible to stabilize a screw fastening torque and prevent the decrease in the joining force.

When the joining of the frame 31 is completed, the operator slides the front side support portions 34*b* in the arrow K2 direction, slides the rear side support portions 34*c* in the arrow K4 direction, and detaches the frame 31 from the jig 34. As a result, the frame 31 is completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-158412, filed Aug. 30, 2019, No. 2019-158418, filed Aug. 30, 2019, which are hereby incorporated by reference herein in their entirety.

What is claimed is:

1. A metal frame of an image forming apparatus including an image forming unit which forms an image on a sheet, comprising:

a first support which supports the image forming unit; and a second support which is arranged with an interval from the first support and supports the image forming unit together with the first support;

wherein the second support includes:

a first sheet metal which includes a first flat surface portion in which a through-hole is formed and a bent and raised portion which is bent and raised from the first flat surface portion at a position adjacent to the through-hole, and a second sheet metal which is supported to the first sheet metal and includes a second flat surface portion which is sandwiched between the first flat surface portion and the bent and raised portion and a protruded portion which protrudes from the second flat surface portion in a plate thickness direction of the second flat surface portion at a position overlapping with the through-hole in a vertical direction.

2. The metal frame of an image forming apparatus according to claim 1, wherein the bent and raised portion has a first bent portion which is bent in a plate thickness direction of the first flat surface portion and a second bent portion which is bent from the first bent portion in the vertical direction.

3. The metal frame of an image forming apparatus according to claim 1, wherein the protruded portion abuts on an inner wall of the through-hole to regulate movement of the second support in the vertical direction.

4. The metal frame of an image forming apparatus according to claim 1, wherein the second sheet metal includes a pair of protrusion portions provided below the protruded portion in the vertical direction and protruding in the vertical direction, and wherein the bent and raised portion is located between the pair of protrusion portions in a direction orthogonal to the vertical direction and a plate thickness direction of the first flat surface portion.

5. The metal frame of an image forming apparatus according to claim 4, wherein tips of the pair of protrusion portions are provided with inclined portions inclined with respect to the vertical direction.

6. The metal frame of an image forming apparatus according to claim 1, wherein a tip of the bent and raised portion is provided with another inclined portion inclined with respect to the vertical direction.

7. The metal frame of an image forming apparatus according to claim 1, wherein the through-hole is a hole formed when the bent and raised portion is processed.

8. The metal frame of an image forming apparatus according to claim 1, wherein the protruded portion is formed by performing drawing on the second flat surface portion.

9. The metal frame of an image forming apparatus according to claim 1, wherein between the first sheet metal and the second sheet metal, the first flat surface portion and the second flat surface portion are joined to each other around the bent and raised portion.

10. The metal frame of an image forming apparatus according to claim 9, wherein between the first sheet metal and the second sheet metal, the first flat surface portion and the second flat surface portion are welded to each other around the bent and raised portion.

11. The metal frame of an image forming apparatus according to claim 9, wherein between the first sheet metal and the second sheet metal, the first flat surface portion and the second flat surface portion are fastened to each other by a screw around the bent and raised portion.

12. The metal frame of an image forming apparatus according to claim 1, wherein the first support includes a first side plate which supports the image forming unit and a second side plate which is supported to the first side plate on the first side plate in the vertical direction, wherein the second support includes a third side plate which supports the image forming unit together with the first side plate, a first support column which supports one end side of the third side plate in the plate thickness direction of the second flat surface portion of the second sheet metal, and a second support column which supports the other end side of the third side plate in the plate thickness direction of the second flat surface portion of the second sheet metal, and wherein the first support column includes the first sheet metal and the second sheet metal.

13. An image forming apparatus comprising:

an image forming unit which forms an image on a sheet;

the metal frame of an image forming apparatus according to claim 1; and an outer cover which covers the metal frame of an image forming apparatus.

14. The image forming apparatus according to claim 13, further comprising:

a control board which is supported to the first support and controls the image forming unit.

15. A metal frame of an image forming apparatus including an image forming unit which forms an image on a sheet, the metal frame comprising:

a first metal plate including a first flat surface portion in which a through-hole is formed and a bent and raised portion which is bent and raised from the first flat surface portion; and a second metal plate which is connected to the first metal plate, the second metal plate including a second flat surface portion which is sandwiched between the first flat surface portion and the bent and raised portion and a protruded portion which protrudes from the second flat surface portion in a plate thickness direction of the second flat surface portion, wherein the protruded portion is located at an inward portion of the through-hole in view of a plate-width direction of the second flat surface portion.

16. The metal frame of an image forming apparatus according to claim 15, wherein the through-hole is formed when the bent and raised portion is processed.

17. The metal frame of an image forming apparatus according to claim 15, wherein the protruded portion is formed by performing drawing on the second flat surface portion.

18. The metal frame of an image forming apparatus according to claim 15, wherein between the first sheet metal and the second sheet metal, the first flat surface portion and the second flat surface portion are welded to each other around the bent and raised portion.

19. The metal frame of an image forming apparatus according to claim 15, wherein between the first sheet metal and the second sheet metal, the first flat surface portion and the second flat surface portion are fastened to each other by a screw around the bent and raised portion.

20. The metal frame of an image forming apparatus according to claim 15, wherein the bent and raised portion has a first bent portion which is bent in a plate thickness direction of the first flat surface portion and a second bent portion which is bent from the first bent portion in a vertical direction.

21. The metal frame of an image forming apparatus according to claim 15, further comprising:

a first support which includes a first side plate which supports the image forming unit and a second side plate which is supported to the first side plate on the first side plate in the vertical direction;

a second support which includes a third side plate which supports the image forming unit together with the second side plate, a first support column which supports the third side plate, and a second support column which supports the third side plate together with the first support column, wherein the first support column includes the first metal plate and the second metal plate.

22. An image forming apparatus comprising:

an image forming unit which forms an image on a sheet;

the metal frame of an image forming apparatus according to claim 21; and an outer cover which covers the metal frame of an image forming apparatus.

23. A metal frame of an image forming apparatus including an image forming unit which forms an image on a sheet, the metal frame comprising:

a first metal plate including a first flat surface portion, a bent and raised portion which is bent and raised from the first flat surface portion, and a protruded portion which protrudes from the first flat surface portion in a plate thickness direction of the first flat surface portion; and a second metal plate which is connected to the first metal plate, the second metal plate including a second flat surface portion in which a through-hole is formed, the second flat surface portion being sandwiched between the first flat surface portion and the bent and raised portion, wherein the protruded portion is located at inward portion of the through-hole in view of a plate-width direction of the first flat surface portion.

24. The metal frame of an image forming apparatus according to claim 23, wherein between the first sheet metal and the second sheet metal, the first flat surface portion and the second flat surface portion are welded to each other around the bent and raised portion.

25. The metal frame of an image forming apparatus according to claim 23, wherein between the first sheet metal and the second sheet metal, the first flat surface portion and the second flat surface portion are fastened to each other by a screw around the bent and raised portion.

26. The metal frame of an image forming apparatus according to claim 23, wherein the bent and raised portion has a first bent portion which is bent in a plate thickness direction of the first flat surface portion and a second bent portion which is bent from the first bent portion in the vertical direction.

27. The metal frame of an image forming apparatus according to claim 23, further comprising:

a first support which includes the first metal plate which supports the image forming unit and the second metal plate which is supported to the first metal plate; and a second support which includes a side plate which supports the image forming unit together with the first metal plate, a first support column which supports the side plate, and a second support column which supports the side plate together with the first support column.

28. An image forming apparatus comprising:

an image forming unit which forms an image on a sheet;

the metal frame of an image forming apparatus according to claim 27; and an outer cover which covers the metal frame of an image forming apparatus.

* * * * *